US007130796B2

(12) United States Patent
Tasaki

(10) Patent No.: US 7,130,796 B2
(45) Date of Patent: Oct. 31, 2006

(54) VOICE ENCODING METHOD AND APPARATUS OF SELECTING AN EXCITATION MODE FROM A PLURALITY OF EXCITATION MODES AND ENCODING AN INPUT SPEECH USING THE EXCITATION MODE SELECTED

(75) Inventor: Hirohisa Tasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 684 days.

(21) Appl. No.: 10/072,892

(22) Filed: Feb. 12, 2002

(65) Prior Publication Data

US 2002/0147582 A1 Oct. 10, 2002

(30) Foreign Application Priority Data

Feb. 27, 2001 (JP) ..... 2001-052944

(51) Int. Cl.
*G10L 19/10* (2006.01)

(52) U.S. Cl. ..... 704/223

(58) Field of Classification Search ..... 704/208, 704/214, 215, 219, 220, 223, 226
See application file for complete search history.

(56) References Cited

U.S. PATENT DOCUMENTS 6,202,046 B1 * 3/2001 Oshikiri et al. ..... 704/233
6,233,550 B1 * 5/2001 Gersho et al. ..... 704/208
6,311,154 B1 * 10/2001 Gersho et al. ..... 704/219
6,330,534 B1 * 12/2001 Yasunaga et al. ..... 704/223
6,510,407 B1 * 1/2003 Wang ..... 704/207
6,697,430 B1 * 2/2004 Yasunari et al. ..... 375/240.13

FOREIGN PATENT DOCUMENTS

EP 0 424 162 A2 * 10/1990
EP 1 052 620 A 11/2000
JP 3-156498 7/1991
JP 04-097199 3/1992
JP 404067200 A * 3/1992 ..... 704/214

(Continued)

OTHER PUBLICATIONS

Das et al., "Multimode variable bit rate speech coding: An efficient paradigm for high-quality low-rate representation of speech signal," *Acoustics, Speech, and Signal Processing: 1999 Proceedings of the 1999 IEEEE International Conference*, Mar. 15, 1999, pp. 2307-2310.

(Continued)

*Primary Examiner*—Abul K. Azad
(74) *Attorney, Agent, or Firm*—Birch, Stewart, Kolasch & Birch, LLP

(57) ABSTRACT

A speech coding apparatus includes driving excitation coding units, a comparator and a selecting unit. The driving excitation coding units encode in respective excitation modes a target signal to be encoded that is obtained from the input speech, and output coding distortions involved in the encoding. The comparator compares at least one of the coding distortions involved in the encoding with a fixed threshold value or with a threshold value that is determined in response to signal power of the input speech or with a threshold value that is determined in response to signal power of the target signal to be encoded. The selecting unit selects the excitation mode in response to the coding distortions and a compared result of the comparator. The speech coding apparatus can select a more favorable excitation that will provide better speech quality, thereby being able to improve the subjective quality of the speech it outputs by decoding resultant speech code.

17 Claims, 9 Drawing Sheets

FOREIGN PATENT DOCUMENTS

| | | |
|---|---|---|
| JP | 05-150800 | 6/1993 |
| JP | 9-319396 | 12/1997 |
| JP | WO98-40877 | 9/1998 |
| JP | 2000-175598 | 6/2000 |
| JP | 2000-200097 | 7/2000 |
| WO | WO 00 30075 A | 5/2000 |

OTHER PUBLICATIONS

Paksoy et al., "Variable rate speech coding with phonetic segmentation," *Statistical Signal and Array Processing: 1993 Proceedings of the International Conference on Acoustics, Speech, and Signal Processing*, Apr. 27, 1993, pp. 155-158, vol. 4, No. 27.

* cited by examiner

VOICE ENCODING METHOD AND APPARATUS OF SELECTING AN EXCITATION MODE FROM A PLURALITY OF EXCITATION MODES AND ENCODING AN INPUT SPEECH USING THE EXCITATION MODE SELECTED

BACKGROUND OF THE INVENTION

1. Field of the Invention

The present invention relates to a speech coding method and a speech coding apparatus for compressing a digital speech signal to a smaller quantity of information, and more particularly to the encoding of the excitation in the speech coding method and speech coding apparatus.

2. Description of Related Art

Conventional speech coding methods and speech coding apparatuses generally generate speech codes by dividing an input speech into spectrum envelope information and excitation, and by coding them separately on a frame by frame basis. As for the coding of the excitation, to maintain the coding quality of the input speech with various types of behavior including background noise, the so-called multi-mode coding has been studied which prepares a plurality of excitation modes with different expressions, and selects one of them frame by frame. Speech coding methods and speech coding apparatus for carrying out the conventional multi-mode coding are disclosed in Japanese patent application laid-open No. 3-156498/1991 or international publication No. WO98/40877.

FIG. 8 is a block diagram showing a configuration of a conventional speech coding apparatus disclosed in Japanese patent application laid-open No. 3-156498/1991. In this figure, the reference numeral 1 designates an input speech, 2 designates a linear prediction analyzing unit, 3 designates a linear prediction coefficient coding unit, 7 designates a multiplexer, 8 designates a speech code, and 47 designates an excitation coding section. In the excitation coding section 47, 48 designates a classifying unit, 49 and 50 each designate a switch, 51 designates a multi-pulse excitation coding unit, and 52 designates a vowel segment excitation coding unit.

Next, the operation of the conventional speech coding apparatus disclosed in Japanese patent application laid-open No. 3-156498 will be described.

The conventional speech coding apparatus with the configuration as shown in FIG. 8 carries out its processing for each frame with a fixed length, a 10 ms long frame, for example.

First, the input speech 1 is supplied to the linear prediction analyzing unit 2, the classifying unit 48 and the switch 49. The linear prediction analyzing unit 2 analyzes the input speech 1, and extracts the linear prediction coefficients constituting the spectrum envelope information of the speech. The linear prediction coefficient coding unit 3 encodes the extracted linear prediction coefficients, and supplies the code to the multiplexer 7. In addition, it outputs linear prediction coefficients which are quantized for the encoding of the excitation.

The classifying unit 48 analyzes the acoustic characteristic of the input speech 1, classifies it into a vowel signal and the other signal, and supplies the classified result to the switches 49 and 50. The switch 49 connects the input speech 1 to the vowel segment excitation coding unit 52 when the classified result by the classifying unit 48 is the vowel signal, and connects the input speech 1 to the multi-pulse excitation coding unit 51 when the classified result by the classifying unit 48 is other than the vowel signal.

The multi-pulse excitation coding unit 51 encodes the excitation by combining a plurality of pulse trains, and supplies the encoded result to the switch 50. The vowel segment excitation coding unit 52 calculates segment lengths with variable duration, encodes the excitation of the segments using a multi-pulse excitation model with improved pitch interpolation, and supplies the encoded result to the switch 50.

The switch 50 connects the encoded result fed from the vowel segment excitation coding unit 52 to the multiplexer 7 when the classified result by the classifying unit 48 is a vowel signal, and the encoded result fed from the multi-pulse excitation coding unit 51 to the multiplexer 7 when the classified result is not the vowel signal. The multiplexer 7 multiplexes the code supplied from the linear prediction coefficient coding unit 3 and the encoded result fed from the switch 50, and outputs a resultant speech code 8.

It is reported that the conventional speech coding apparatus disclosed in Japanese patent application laid-open No. 3-156498/1991 can represent the speech signal in a smaller quantity of information by selecting one of the previously prepared excitation models in accordance with the acoustic characteristics of the input speech 1, and by carrying out encoding using the selected excitation model.

FIG. 9 is a block diagram showing a configuration of another conventional speech coding apparatus disclosed in international publication No. WO98/40877. In this figure, the reference numeral 1 designates an input speech, 2 designates a linear prediction analyzing unit, 3 designates a linear prediction coefficient coding unit, 4 designates an adaptive excitation coding unit, 7 designates a multiplexer, 8 designates a speech code, 53 and 54 each designate a driving excitation coding unit, 55 and 56 each designate a gain coding unit, and 57 designates a minimum distortion selecting unit.

Next, the operation of the conventional speech coding apparatus disclosed in the international publication No. WO98/40877 will be described.

The conventional speech coding apparatus with the configuration as shown in FIG. 9 carries out its processing on a frame by frame basis, the frame consisting of a speech segment with the duration of about 5–50 ms. As for the encoding of the excitation, it carries out its processing for each sub-frame with the duration of half the frame. For the sake of simplicity, the two terms "frame" and "sub-frame" are not distinguished, and are called "frame" from now on.

First, the input speech 1 is supplied to the linear prediction analyzing unit 2, adaptive excitation coding unit 4 and driving excitation coding unit 53. The linear prediction analyzing unit 2 analyzes the input speech 1, and extracts the linear prediction coefficients constituting the spectrum envelope information of the speech. The linear prediction coefficient coding unit 3 encodes the linear prediction coefficients, supplies its code to the multiplexer 7, and outputs the linear prediction coefficients that are quantized for the coding of the excitation.

The adaptive excitation coding unit 4 stores previous excitation with a predetermined length as an adaptive excitation code book. Receiving an adaptive excitation code represented by a binary number of a few bits, the adaptive excitation codebook calculates a repetition period from the adaptive excitation code, and generates time-series vectors that cyclically repeats the previous excitation by using the repetition period. The adaptive excitation coding unit 4 produces a temporary synthesized signal by passing the individual time-series vectors, which are obtained by inputting the individual adaptive excitation codes into the adaptive excitation codebook, through the synthesis filter that uses the quantized linear prediction coefficients fed from the linear prediction coefficient coding unit 3. Then, the distortion is detected between the input speech 1 and the signal obtained by multiplying the temporary synthesized signal by a gain. The processing is carried out for all the adaptive excitation codes, and the adaptive excitation code that gives the minimum distortion is selected so that the time-series vector corresponding to the selected adaptive excitation code is output as the adaptive excitation. In addition, the signal obtained by subtracting from the input speech 1 a signal that is produced by multiplying the synthesized signal based on the adaptive excitation by an appropriate gain is output as a target signal to be encoded.

The driving excitation coding unit 54 stores a plurality of time-series vectors as a driving excitation codebook. The driving excitation codebook, receiving the driving excitation code represented by a binary number of a few bits, reads the time-series vector stored in the position corresponding to the driving excitation code and outputs it. The driving excitation coding unit 54 obtains the individual time-series vectors by supplying the driving excitation codebook with the individual adaptive excitation codes, and obtains the temporary synthesized signal by passing them through the synthesis filter using the quantized linear prediction coefficients fed from the linear prediction coefficient coding unit 3. Then, the driving excitation coding unit 54 detects the distortion between the signal, which is obtained by multiplying the temporary synthesized signal by the appropriate gain, and the target signal to be encoded supplied from the adaptive excitation coding unit 4. It carries out the processing for all the driving excitation codes, and selects the driving excitation code that gives the minimum distortion, and outputs the time-series vector corresponding to the selected driving excitation code as the driving excitation.

The gain coding unit 56 stores a plurality of gain vectors representing two gain values corresponding to the adaptive excitation and driving excitation as the gain codebook. The gain codebook, receiving the gain code represented by a binary number of a few bits, reads the gain vector stored in the position corresponding to the gain code, and outputs it. The gain coding unit 56 obtains the gain vectors by supplying the gain codebook with the individual gain codes, multiplies the adaptive excitation fed from the adaptive excitation coding unit 4 by the first element of the gain vector, multiplies the driving excitation fed from the driving excitation coding unit 54 by the second element of the gain vector, and generates the temporary excitation by adding the two signals. Then, it obtains the temporary synthesized signal bypassing the temporary excitation through the synthesis filter using the quantized linear prediction coefficients fed from the linear prediction coefficient coding unit 3, and detects the distortion between the temporary synthesized signal and the input speech 1 fed via the driving excitation coding unit 54. It carries out the processing for all the gain codes, and selects the gain code that gives the minimum distortion. The gain coding unit 56 supplies the minimum distortion selecting unit 57 with the selected gain code, the adaptive excitation code fed from the adaptive excitation coding unit 4 via the driving excitation coding unit 54, the driving excitation code fed from the driving excitation coding unit 54, the minimum distortion, and the temporary excitation corresponding to the selected gain code.

On the other hand, the driving excitation coding unit 53 stores a plurality of time-series vectors as a driving excitation codebook. The driving excitation codebook, receiving the driving excitation code represented by a binary number of a few bits, reads the time-series vector stored in the position corresponding to the driving excitation code, and outputs it. The driving excitation coding unit 53 obtains the individual time-series vectors by supplying the driving excitation codebook with the individual adaptive excitation codes, and obtains the temporary synthesized signal by passing them through the synthesis filter using the quantized linear prediction coefficients fed from the linear prediction coefficient coding unit 3. Then, the driving excitation coding unit 53 detects the distortion between the signal which is obtained by multiplying the temporary synthesized signal by the appropriate gain and the input speech signal 1. It carries out the processing for all the driving excitation codes, and selects the driving excitation code that gives the minimum distortion, and outputs the time-series vector corresponding to the selected driving excitation code as the driving excitation.

The gain coding unit 55 stores a plurality of gain values for the driving excitation as a first gain codebook. The gain codebook, receiving the gain code represented by a binary number of a few bits, reads the gain value stored in the position corresponding to the gain code, and outputs it. The gain coding unit 55 obtains the gain values by supplying the gain codebook with the individual gain codes, multiplies the gain value by the driving excitation fed from the driving excitation coding unit 53, and produces the resultant signal as the temporary excitation. Then, it obtains the temporary synthesized signal by passing the temporary excitation through the synthesis filter using the quantized linear prediction coefficients fed from the linear prediction coefficient coding unit 3, and detects the distortion between the temporary synthesized signal and the input speech 1 fed via the driving excitation coding unit 53. It carries out the processing for all the gain codes, and selects the gain code that gives the minimum distortion. The gain coding unit 55 supplies the minimum distortion selecting unit 57 with the excitation code that includes the selected gain code and the driving excitation code fed from the driving excitation coding unit 53, and with the minimum distortion, and the temporary excitation corresponding to the gain code selected.

The minimum distortion selecting unit 57 compares the minimum distortion supplied from the gain coding unit 55 with the minimum distortion supplied from the gain coding unit 56, selects the gain coding unit 55 or 56 that outputs the lesser distortion, and supplies the multiplexer 7 with the excitation code fed from the selected gain coding unit 55 or 56. The minimum distortion selecting unit 57 supplies the adaptive excitation coding unit 4 with the temporary excitation fed from the selected gain coding unit 55 or 56 as the final excitation. The adaptive excitation coding unit 4 updates the internal adaptive excitation codebook using the excitation fed from the minimum distortion selecting unit 57.

After that, the multiplexer 7 multiplexes the code of the linear prediction coefficients supplied from the linear prediction coefficient coding unit 3 and the excitation code output from the minimum distortion selecting unit 57, and outputs the resultant speech code 8.

Thus, it is reported that the conventional speech coding apparatus disclosed in the international publication No. WO98/40877 carries out encoding in both the two excitation modes, and selects the excitation mode that gives a smaller distortion, thereby making it possible to select the mode that provides the best encoding characteristics, and to improve the coding quality.

As documents relevant to such a speech coding apparatus, there are Japanese patent application laid-open Nos. 9-319396 and 2000-175598, for example. The former generates target speech vectors with a length corresponding to a delay parameter from the input speech, and carries out adaptive excitation search and driving excitation search. The latter selects a gain quantization table corresponding to the driving excitation from a plurality of gain quantization tables in accordance with the power information of the adaptive excitation signal.

With the foregoing configuration, the conventional speech coding apparatuses have the following problems As for the conventional speech coding apparatus disclosed in Japanese patent application laid-open No. 3-156498, since it selects one of the plurality of excitation models which are prepared in advance in accordance with the acoustic characteristics of the input speech 1, it has a problem in that the subjective quality, that is, quality of the decoded speech produced by decoding resultant speech code by the speech decoding apparatus is not always optimum. In other words, since the classification in accordance with the acoustic characteristics of the input speech 1 always involves classifying error, an excitation model inappropriate for the input speech may be selected. In addition, although the classification of the input speech 1 is correct, it is not unlikely that an unselected excitation model could produce higher quality decoded speech rather than the selected excitation model when the speech decoding apparatus performs decoding. For example, when a vowel segment includes a lot of waveform distortion such as in transitions, it is probable that using multi-pulses can handle the variations better and produce more satisfactory encoded result than the vowel segment excitation coding unit 52.

As for the conventional speech coding apparatus disclosed in the international publication No. WO98/40877, it carries out encoding in the two excitation modes, and selects the excitation mode that provides the smaller distortion. Accordingly, although it can achieve the minimum coding distortion, it has a problem in that the subjective quality (speech quality) of the decoded speech is not always best which is obtained by decoding the resultant speech code by the speech decoding apparatus. The problem will be described in more detail with reference to FIG. 7.

FIG. 7(*a*) shows an input speech; FIG. 7(*b*) shows a decoded speech (a result of decoding the speech code by the speech decoding apparatus) when an excitation mode prepared to express noisy speech is selected; and FIG. 7(*c*) shows a decoded speech when an excitation mode prepared to express vowel-like speech is selected. Here, the input speech as shown in FIG. 7(*a*) is associated with a segment with a noisy characteristic, in which large and small amplitudes are mixed often in a frame.

In the example of FIG. 7, the distortion value between the signals of FIGS. 7(*a*) and 7(*b*), which is obtained as the power of the difference signal thereof, is greater than that between FIGS. 7(*a*) and 7(*c*). This is because a portion of the input speech that has large amplitude (see, FIG. 7(*a*) ) has a smaller difference from the corresponding portion of FIG. 7(*c*). However, the sound of FIG. 7(*b*) sounds better than that of FIG. 7(*c*) for human ear, because the latter provides a pulse-like corrupt sound. Thus, the conventional speech coding apparatus that selects the excitation mode with the minimum distortion can select the mode in which the subjective quality (speech quality) of the decoded speech is not optimum which is obtained by decoding the resultant speech code by the speech decoding apparatus.

SUMMARY OF THE INVENTION

The present invention is implemented to solve the foregoing problems. It is therefore an object of the present invention to provide a speech coding method and speech coding apparatus capable of selecting an excitation that will provide better speech quality, and of improving the subjective quality, that is, the quality of the decoded speech obtained by decoding the resultant speech code by the speech decoding apparatus.

According to a first aspect of the present invention, there is provided a speech coding method of selecting an excitation mode from a plurality of excitation modes, and encoding an input speech frame by frame with a predetermined length by using the excitation mode selected, the speech coding method comprising the steps of: encoding in the respective excitation modes a target signal to be encoded that is obtained from the input speech, and outputting coding distortions involved in the encoding; comparing at least one of the coding distortions involved in the encoding with one of three threshold values consisting of a fixed threshold value, a threshold value that is determined in response to signal power of the input speech and a threshold value that is determined in response to signal power of the target signal to be encoded; and selecting the excitation mode in response to the coding distortions involved in the encoding and a compared result at the step of comparing.

According to a second aspect of the present invention, there is provided a speech coding method of selecting an excitation mode from a plurality of excitation modes, and encoding an input speech frame by frame with a predetermined length by using the excitation mode selected, the speech coding method comprising the steps of: encoding in the respective excitation modes a target signal to be encoded that is obtained from the input speech, and outputting coding distortions involved in the encoding; selecting one of the excitation modes in response to a compared result obtained by comparing the coding distortions involved in the encoding; comparing the coding distortion corresponding to the excitation mode selected at the step of selecting with one of three threshold values consisting of a fixed threshold value, a threshold value that is determined in response to signal power of the input speech and a threshold value that is determined in response to signal power of the target signal to be encoded; and replacing the excitation mode selected at the step of selecting, in response to a compared result obtained at the step of comparing.

Here, the step of selecting may suppress selecting the excitation mode that gives a compared result that the coding distortion is greater than the threshold value.

The threshold value may be prepared for each excitation mode.

The speech coding method may further comprise a step of converting the coding distortion by replacing it with the threshold value, when a compared result obtained at the step of comparing indicates that the coding distortion is greater than the threshold value, wherein the step of selecting may select an excitation mode corresponding to a minimum coding distortion among the coding distortions of all the excitation modes including the coding distortion output at the step of replacing.

The step of replacing may select a predetermined excitation mode when the coding distortion corresponding to the excitation mode selected at the step of selecting is greater than the threshold value.

The threshold value may be set at a value constituting a predetermined distortion ratio to one of the input speech and the target signal to be encoded.

The speech coding method may further comprise the step of deciding an aspect of speech by analyzing at least one of the input speech and the target signal to be encoded, wherein the step of selecting may select the excitation mode without using the compared result at the step of comparing, only when the step of deciding outputs a predetermined decision result.

The speech coding method may further comprise the steps of: deciding an aspect of speech by analyzing at least one of the input speech and the target signal to be encoded; and calculating a threshold value in response to a decision result at the step of deciding, wherein the step of comparing may carry out its comparison using the threshold value calculated at the step of calculating the threshold value.

The step of deciding may make a decision as to whether the aspect of speech is onset of speech or not.

The plurality of excitation modes may comprise an excitation mode that generates non-noisy excitation, and an excitation mode that generates noisy excitation.

The plurality of excitation modes may comprise an excitation mode that uses non-noisy excitation codewords, and an excitation mode that uses noisy excitation codewords.

According to a third aspect of the present invention, there is provided a speech coding apparatus that selects an excitation mode from a plurality of excitation modes, and encodes an input speech frame by frame with a predetermined length by using the excitation mode selected, the speech coding apparatus comprising: coding units for encoding in the respective excitation modes a target signal to be encoded that is obtained from the input speech, and outputting coding distortions involved in the encoding; a comparator for comparing at least one of the coding distortions involved in the encoding with one of three threshold values consisting of a fixed threshold value, a threshold value that is determined in response to signal power of the input speech and a threshold value that is determined in response to signal power of the target signal to be encoded; and a selecting unit for selecting the excitation mode in response to the coding distortions involved in the encoding by the coding units and a compared result of the comparator.

According to a fourth aspect of the present invention, there is provided a speech coding apparatus for selecting an excitation mode from a plurality of excitation modes, and encoding an input speech frame by frame with a predetermined length by using the excitation mode selected, the speech coding apparatus comprising: coding units for encoding in the respective excitation modes a target signal to be encoded that is obtained from the input speech, and outputting coding distortions involved in the encoding; a selecting unit for comparing the coding distortions involved in the encoding by the coding units, and for selecting one of the excitation modes in response to a compared result obtained; a comparator for comparing the coding distortion corresponding to the excitation mode selected by the selecting unit with one of three threshold values consisting of a fixed threshold value, a threshold value that is determined in response to signal power of the input speech and a threshold value that is determined in response to signal power of the target signal to be encoded; and a substituting unit for replacing the excitation mode selected by the selecting unit, in response to a compared result of the comparator.

Here, the comparator may set its threshold value to be compared with the coding distortion, at a value constituting a predetermined distortion ratio to one of the input speech and the target signal to be encoded.

The speech coding apparatus may further comprise a deciding unit for deciding an aspect of speech by analyzing at least one of the input speech and the target signal to be encoded, wherein the selecting unit may select the excitation mode without using the compared result of the comparator, only when the deciding unit outputs a predetermined decision result.

The plurality of excitation modes may comprise an excitation mode that generates non-noisy excitation, and an excitation mode that generates noisy excitation.

DETAILED DESCRIPTION OF THE PREFERRED EMBODIMENTS

The invention will now be described with reference to the accompanying drawings.

Embodiment 1

Figure 1:
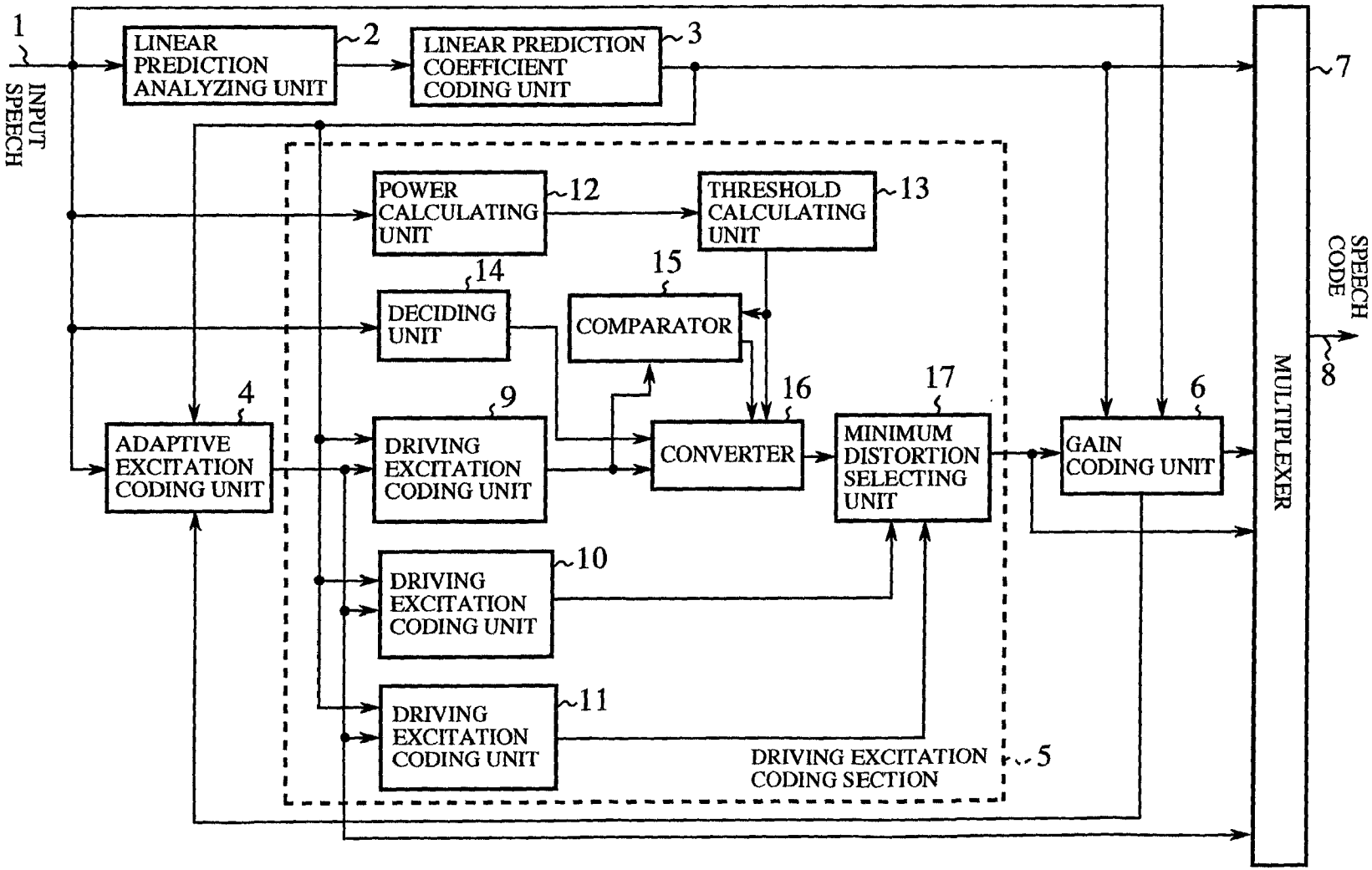
FIG. 1 is a block diagram showing a configuration of a speech coding apparatus employing a speech coding method of an embodiment 1 in accordance with the present invention.

FIG. 1 is a block diagram showing a configuration of a speech coding apparatus employing a speech coding method of an embodiment 1 in accordance with the present invention. In this figure, the reference numeral 1 designates an input speech supplied to the speech coding apparatus; 2 designates a linear prediction analyzing unit for extracting linear prediction coefficients from the input speech 1; and 3 designates a linear prediction coefficient coding unit for quantizing the extracted linear prediction coefficients to encode them. The reference numeral 4 designates an adaptive excitation coding unit for generating an adaptive excitation and a target signal to be encoded from the input speech 1 and the signal fed from the linear prediction coefficient coding unit 3. The reference numeral 5 designates a driving excitation coding section for generating a driving excitation and a driving excitation code, and mode selection information from the input speech 1, a signal fed from the linear prediction coefficient coding unit 3 and a signal fed from the adaptive excitation coding unit 4. The reference numeral 6 designates a gain coding unit for selecting a gain code by receiving the input speech 1, the signal from the linear prediction coefficient coding unit 3 and the signal from the driving excitation coding section 5, and for supplying the excitation corresponding to the gain code to the adaptive excitation coding unit 4. The reference numeral 7 designates a multiplexer for multiplexing the signals supplied from the linear prediction coefficient coding unit 3, adaptive excitation coding unit 4, driving excitation coding section 5 and gain coding unit 6. The reference numeral 8 designates a speech code that is output from the multiplexer 7 as the encoded output of the speech coding apparatus.

In the driving excitation coding section 5, the reference numeral 9 designates a driving excitation coding unit that comprises a driving excitation codebook consisting of time-series vectors generated from random numbers, and that generates a driving excitation code, distortion and driving excitation by detecting a distortion between the temporary synthesized signal and the target signal to be encoded by using the signals from the linear prediction coefficient coding unit 3 and the adaptive excitation coding unit 4. The reference numerals 10 and 11 each designate a driving excitation code unit that comprises a driving excitation codebook including a different pulse position table, and that generates a driving excitation code, distortion and driving excitation by detecting a distortion between the temporary synthesized signal and the target signal to be encoded by using the signals from the linear prediction coefficient coding unit 3 and the adaptive excitation coding unit 4. The reference numeral 12 designates a power calculating unit for calculating signal power of the input speech 1, and 13 designates a threshold calculating unit for calculating a threshold value associated with the distortion from the signal fed from the power calculating unit 12. The reference numeral 14 designates a deciding unit for making a decision by analyzing the input speech 1 as to whether it is the onset of speech. The reference numeral 15 designates a comparator for comparing the signal fed from the driving excitation coding unit 9 with the threshold value fed from the threshold calculating unit 13. The reference numeral 16 designates converter for converting the output of the driving excitation coding unit 9 in response to the decision result of the deciding unit 14 and the compared result of the comparator 15. The reference numeral 17 designates a minimum distortion selecting unit for supplying the multiplexer 7 with the driving excitation, driving excitation code and mode selection information in response to the signal from the converter 16, and signals from the driving excitation coding units 10 and 11.

Next, the operation of the present embodiment 1 will be described.

The speech coding apparatus of the present embodiment 1 carries out its processing on a frame by frame basis, the length of the frame being 20 ms, for example. As for the encoding of the excitation, that is, the processing of the adaptive excitation coding unit 4, driving excitation coding section 5 and gain coding unit 6, it is carried out for each sub-frame with a length of half a frame. However, for the sake of simplicity, both the frame and sub-frame are referred to as a frame as in the conventional case from now on.

First, the input speech 1 is supplied to the linear prediction analyzing unit 2, adaptive excitation coding unit 4, driving excitation coding section 5 and gain coding unit 6. Here, the input speech 1 supplied to the driving excitation coding section 5 is transferred to the power calculating unit 12 and deciding unit 14. Receiving the input speech 1, the linear prediction analyzing unit 2 analyzes it to extract the linear prediction coefficients constituting the spectrum envelope information of the speech, and transfers them to the linear prediction coefficient coding unit 3. The linear prediction coefficient coding unit 3 encodes the linear prediction coefficients fed from the linear prediction analyzing unit 2 and supplies the encoded result to the multiplexer 7. It also supplies the linear prediction coefficients that are quantized to encode the excitation, to the adaptive excitation coding unit 4, driving excitation coding section 5 and gain coding unit 6. In the driving excitation coding section 5, the quantized linear prediction coefficients fed from the linear prediction coefficient coding unit 3 are supplied to the driving excitation coding units 9–11.

Although the present embodiment 1 uses the linear prediction coefficients as the spectrum envelope information, this is not essential. For example, other parameters such as LSP (Line Spectrum Pairs) are also applicable.

The adaptive excitation coding unit 4 comprises an adaptive excitation codebook storing previous excitation with a predetermined length. The adaptive excitation codebook, receiving an adaptive excitation code represented in a binary number of a few bits, obtains the repetition period of the previous excitation corresponding to the adaptive excitation code, generates time-series vectors that cyclically repeats the previous excitation by using the repetition period, and outputs the time-series vectors. The adaptive excitation coding unit 4 obtains a temporary synthesized signal by filtering the individual time-series vectors, which are obtained by inputting the individual adaptive excitation code to the adaptive excitation codebook, through a synthesis filter using the quantized linear prediction coefficients supplied from the linear prediction coefficient coding unit 3. Then, it detects a distortion between the input speech 1 and a signal obtained by multiplying the resultant temporary synthesized signal by an appropriate gain.

Performing this processing on all the adaptive excitation codes, the adaptive excitation coding unit 4 selects the adaptive excitation code that gives the minimum distortion, and supplies the time-series vector corresponding to the selected adaptive excitation code to the driving excitation coding unit 9, and to the driving excitation coding units 10 and 11 as the adaptive excitation. It also supplies the signal, which is obtained by subtracting from the input speech 1 a product obtained by multiplying the synthesized signal derived from the adaptive excitation by the appropriate gain (the distortion between the two signals), to the driving excitation coding unit 9 and driving excitation coding units 10 and 11 as the target signal to be encoded.

In the driving excitation coding unit 9, the driving excitation codebook stores a plurality of time-series vectors generated from random numbers as noisy excitation codewords. The driving excitation codebook in the driving excitation coding unit 9, receiving the driving excitation code represented by a binary number of a few bits, reads the time-series vector stored at the position corresponding to the driving excitation code, and outputs it. In this case, the output time-series vector constitutes noisy excitation. The driving excitation coding unit 9 obtains a temporary synthesized signal by filtering the individual time-series vectors, which are obtained by inputting the individual driving excitation codes to the driving excitation codebook, through a synthesis filter using the quantized linear prediction coefficients supplied from the linear prediction coefficient coding unit 3. Then, it detects the distortion between a signal which is obtained by multiplying the resultant temporary synthesized signal by an appropriate gain and a target signal to be encoded which is supplied from the adaptive excitation coding unit 4. The distortion D between them is obtained by the following expression (1):

$$D = \sum_i x_i^2 - \frac{\left(\sum_i x_i y_i\right)^2}{\sum_i y_i^2} \tag{1}$$

Where x is the target signal to be encoded, and y is the temporary synthesized signal.

The driving excitation coding unit 9 performs this processing on all the driving excitation codes. Thus, it selects the driving excitation code that gives the minimum distortion, and supplies the time-series vector corresponding to the selected driving excitation code to the comparator 15 and converter 16 as the driving excitation. At the same time, it also supplies the minimum distortion and driving excitation code to the comparator 15 and converter 16 in addition to the driving excitation.

The driving excitation coding unit 10 stores a driving excitation codebook including a pulse position table. The driving excitation codebook in the driving excitation coding unit 10, receiving the driving excitation code represented by a binary number of a few bits, divides the driving excitation code into plural pulse position codes and plural polarities, reads the pulse positions stored in the positions corresponding to the individual pulse position codes in the pulse position table, and outputs a time-series vector having a plurality of pulses in response to the pulse positions and polarities. Thus, the output time-series vector constitutes non-noisy excitation consisting of a plurality of pulses. The driving excitation codebook in the driving excitation coding unit 10 is considered to store the non-noisy excitation codewords in the form of the pulse position table.

The driving excitation coding unit 10 obtains the temporary synthesized signal as follows. First, it conducts the pitch filtering of the time-series vectors, which are obtained by inputting the individual adaptive excitation codes to the driving excitation codebook, by using the repetition period corresponding to the adaptive excitation codes selected by the adaptive excitation coding unit 4. Subsequently, it filters the time-series vectors through the synthesis filter that uses the quantized linear prediction coefficients output from the linear prediction coefficient coding unit 3, thereby obtaining the temporary synthesized signal. Then, it detects the distortion between the signal which is obtained by multiplying the resultant temporary synthesized signal by an appropriate gain and the target signal to be encoded which is supplied from the adaptive excitation coding unit 4.

The driving excitation coding unit 10 performs this processing on all the driving excitation codes, selects the driving excitation code that gives the minimum distortion, and adopts the time-series vector corresponding to the selected excitation code as the driving excitation. Then, it supplies the driving excitation to the minimum distortion selecting unit 17 along with the minimum distortion and driving excitation code.

The driving excitation coding unit 11 stores a driving excitation codebook including a pulse position table different from that of the driving excitation coding unit 10. The driving excitation codebook in the driving excitation coding unit 11, receiving the driving excitation code represented by a binary number of a few bits, divides the driving excitation code into plural pulse position codes and plural polarities, reads the pulse positions stored in the positions corresponding to the individual pulse position codes in the pulse position table, and outputs a time-series vector having a plurality of pulses in response to the pulse positions and polarities. Thus, as in the driving excitation coding unit 10, the output time-series vector constitutes non-noisy excitation consisting of a plurality of pulses. The driving excitation codebook in the driving excitation coding unit 11 is considered to store the non-noisy excitation codewords in the form of the pulse position table.

The driving excitation coding unit 11 obtains the temporary synthesized signal as follows. First, it conducts the pitch filtering of the time-series vectors, which are obtained by inputting the individual adaptive excitation codes to the driving excitation codebook, by using the repetition period corresponding to the adaptive excitation codes selected by the adaptive excitation coding unit 4. Subsequently, it filters the time-series vectors through the synthesis filter that uses the quantized linear prediction coefficients output from the linear prediction coefficient coding unit 3, thereby obtaining the temporary synthesized signal. Then, it detects the distortion between the signal which is obtained by multiplying the resultant temporary synthesized signal by an appropriate gain and the target signal to be encoded which is supplied from the adaptive excitation coding unit 4.

The driving excitation coding unit 11 performs this processing on all the driving excitation codes, selects the driving excitation code that gives the minimum distortion, and adopts the time-series vector corresponding to the selected excitation code as the driving excitation. Then, it supplies the driving excitation to the minimum distortion selecting unit 17 along with the minimum distortion and driving excitation code.

The power calculating unit 12 calculates the signal power in each frame of the input speech 1 provided thereto, and supplies the resultant signal power to the threshold calculating unit 13. The threshold calculating unit 13 multiplies the signal power fed from the power calculating unit 12 by a constant associated with the distortion ratio prepared in advance, and supplies the calculation result to the comparator 15 and converter 16 as the threshold value associated with the distortion.

The threshold value associated with the distortion $D_{th}$ can be obtained by the following equation (2).

$$D_{th}=R\cdot P \tag{2}$$

where R is the constant prepared in advance, and P is the signal power.

Here, the constant R, which is a value associated with the distortion ratio in the power domain, is set at 0.7 in the present embodiment 1. In addition, the threshold value $D_{th}$ associated with the distortion, which is obtained by multiplying the signal power P of the input speech 1 by a constant R associated with the distortion ratio, is a value defined in the distortion domain expressed by the foregoing equation (1).

On the other hand, the deciding unit 14 analyzes the input speech 1 supplied, and decides its aspect of speech. Thus, it assigns "0" to the onset of speech, and "1" to the remaining portions, and outputs them as a decision result. It can roughly make a decision about the onset of speech by checking whether the quotient obtained by dividing the signal power of the input speech 1 by the signal power of the previous frame exceeds a predetermined threshold value.

The comparator 15 compares the distortion D supplied from the driving excitation coding unit 9 with the threshold value associated with the distortion $D_{th}$ supplied from the threshold calculating unit 13, and outputs "1" when the distortion D is greater than the threshold value, and "0" in the other cases. Receiving the decision result from the deciding unit 14 and the compared result from the comparator 15, the converter 16 replaces, when both of them are "1", the distortion D fed from the driving excitation coding unit 9 by the threshold value $D_{th}$ fed from the threshold calculating unit 13. The converter 16 does not carry out the replacement when at least one of the decision result of the deciding unit 14 and the compared result by the comparator 15 is "0". The result of the replacement by the converter 16 is supplied to the minimum distortion selecting unit 17.

The minimum distortion selecting unit 17 compares the three distortions supplied from the converter 16 and the driving excitation coding units 10 and 11, and selects the minimum distortion among them. It supplies the driving excitation and driving excitation code, which are output from the converter 16 or the driving excitation coding unit 10 or 11 that outputs the selected distortion, to the gain coding unit 6 and multiplexer 7, respectively. In addition, it supplies the multiplexer 7 with information indicating which one of the three distortions is selected as the mode selection information.

Since the first term of the foregoing equation (1) is independent of the temporary synthesized signal y, to search y that minimizes the distortion D is equivalent to search y that maximizes the second term of the foregoing equation (1) as shown in the following equation (3).

$$d = \frac{\left(\sum_i x_i y_i\right)^2}{\sum_i y_i^2} \tag{3}$$

Therefore, the same result is obtained by calculating evaluation value d of the foregoing equation (3) for a plurality of temporary synthesized signals y, and by selecting the driving excitation code that gives the temporary synthesized signal y that maximizes the value d. However, in order to allow the individual driving excitation coding units to search for the driving excitation code that maximizes the evaluation value d of the foregoing equation (3), and to output the evaluation value d instead of the distortion D, it is necessary for the threshold calculating unit 13, comparator 15, converter 16 and minimum distortion selecting unit 17 to vary the processing as follows.

More specifically, the threshold calculating unit 13 calculates the threshold value $d_{th}$ corresponding to the evaluation value d by the following equation (4).

$$d_{th} = P' - R \cdot P \tag{4}$$

where P' is the signal power of the target signal x to be encoded.

The foregoing equation (4) is derived by obtaining the following equation (5) by combining the foregoing equations (1) and (3), and by substituting the foregoing equation (2) into the second term of the resultant equation (5). Here, the first term of the following equation (5) is the signal power P' of the target signal to be encoded. In this case, it is necessary for the threshold calculating unit 13 to capture the target signal to be encoded output from the adaptive excitation coding unit 4.

$$d_{th} = \sum_i x_i^2 - D_{th} \tag{5}$$

The comparator 15 compares the evaluation value d supplied from the driving excitation coding unit 9 with the threshold value $d_{th}$ supplied from the threshold calculating unit 13, and outputs "1" when the evaluation value d is smaller than the threshold value, otherwise "0" as the compared result. Receiving the compared result from the comparator 15, and the decision result from the deciding unit 14, the converter 16 replaces, if both of them are "1" the evaluation value d in the result supplied from the driving excitation coding unit 9 by the threshold value $d_{th}$ supplied from the threshold calculating unit 13. In the other cases, the replacement of the evaluation value d is not performed.

The minimum distortion selecting unit 17 is supplied with the evaluation values d from the converter 16 and the driving excitation coding units 10 and 11. The minimum distortion selecting unit 17 compares the three evaluation values d, and selects the maximum evaluation value among them. It supplies the driving excitation and driving excitation code, which are output from the converter 16 or the driving excitation coding unit 10 or 11 that outputs the selected evaluation value, to the gain coding unit 6 and multiplexer 7, respectively. In addition, it supplies the multiplexer 7 with information indicating which one of the three evaluation values is selected as the mode selection information.

The gain coding unit 6 stores a plurality of gain vectors representing two gain values associated with the adaptive excitation and driving excitation as a gain codebook. The gain codebook, receiving a gain code represented by a binary number of a few bits, reads the gain vector stored in the position corresponding to the gain code, and outputs it. The gain coding unit 6 obtains the gain vector by supplying the gain codebook with each gain code, and generates a temporary excitation by multiplying its first element by the adaptive excitation fed from the adaptive excitation coding unit 4, by multiplying its second element by the driving excitation fed from the minimum distortion selecting unit 17, and by adding the resultant two signals. Then, it obtains the temporary synthesized signal by filtering the temporary excitation through the synthesis filter using the quantized linear prediction coefficients supplied from the linear prediction coefficient coding unit 3. Subsequently, it calculates the difference between the resultant temporary synthesized signal and the input speech 1 to detect the distortion between them.

The gain coding unit 6 performs this processing on all the driving excitation codes, selects the gain code that gives the minimum distortion, and supplies the multiplexer 7 with the selected gain code, and the adaptive excitation coding unit 4 with the temporary excitation corresponding to the selected gain code as the final excitation.

The adaptive excitation coding unit 4, receiving the final excitation from the gain coding unit 6, updates its adaptive excitation codebook in response to the final excitation.

Subsequently, the multiplexer 7 multiplexes the linear prediction coefficient code supplied from the linear prediction coefficient coding unit 3, the adaptive excitation code fed from the adaptive excitation coding unit 4, the driving excitation code and mode selection information fed from the minimum distortion selecting unit 17 in the driving excitation coding section 5, and the gain code fed from the gain coding unit 6, and outputs the resultant speech code 8.

Figure 7A:
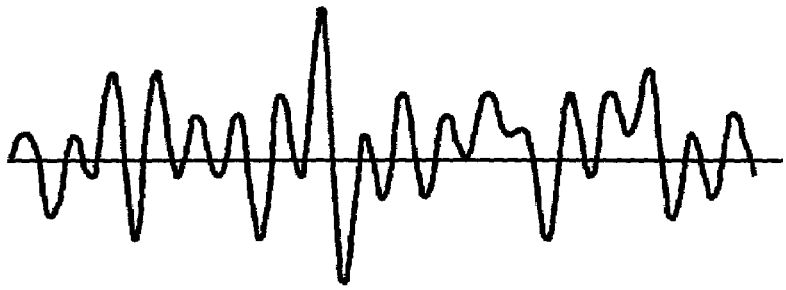
FIG. 7 is a waveform chart illustrating an improvement in the subjective quality of the decoded speech obtained by decoding the speech code by the speech decoding apparatus.
Figure 7B:
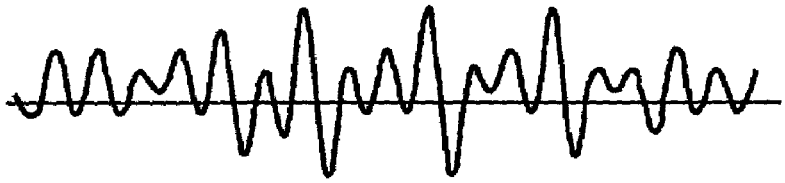
Figure 7C:
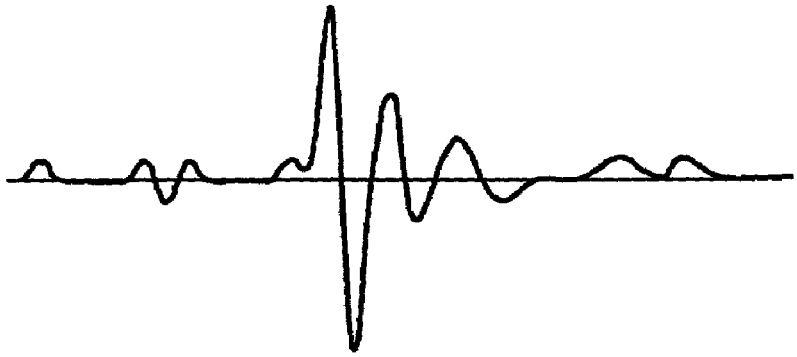
Figure 8:
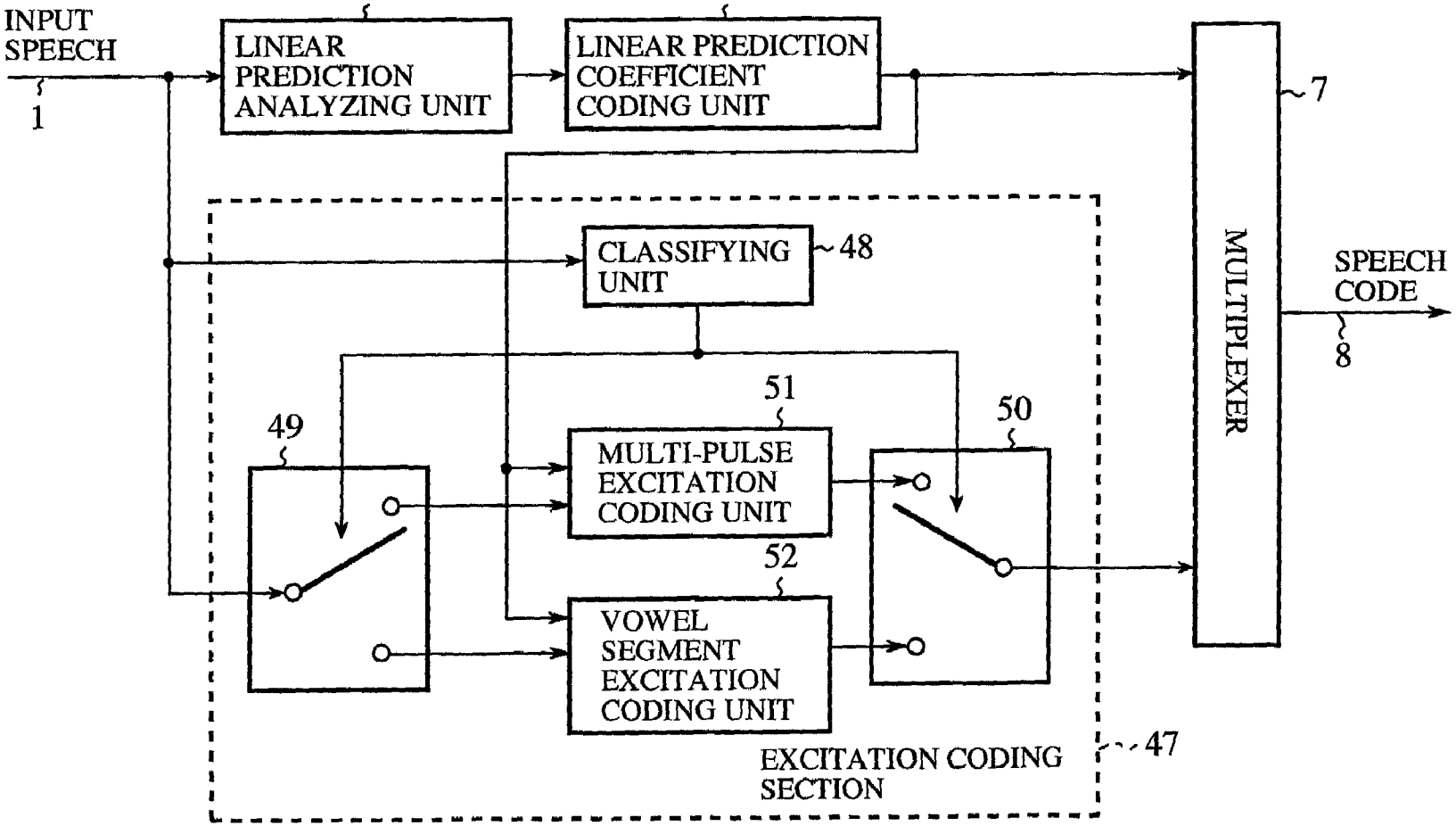
FIG.8 (PRIOR ART)
FIG. 8 is a block diagram showing a configuration of a conventional speech coding apparatus.
Figure 9:
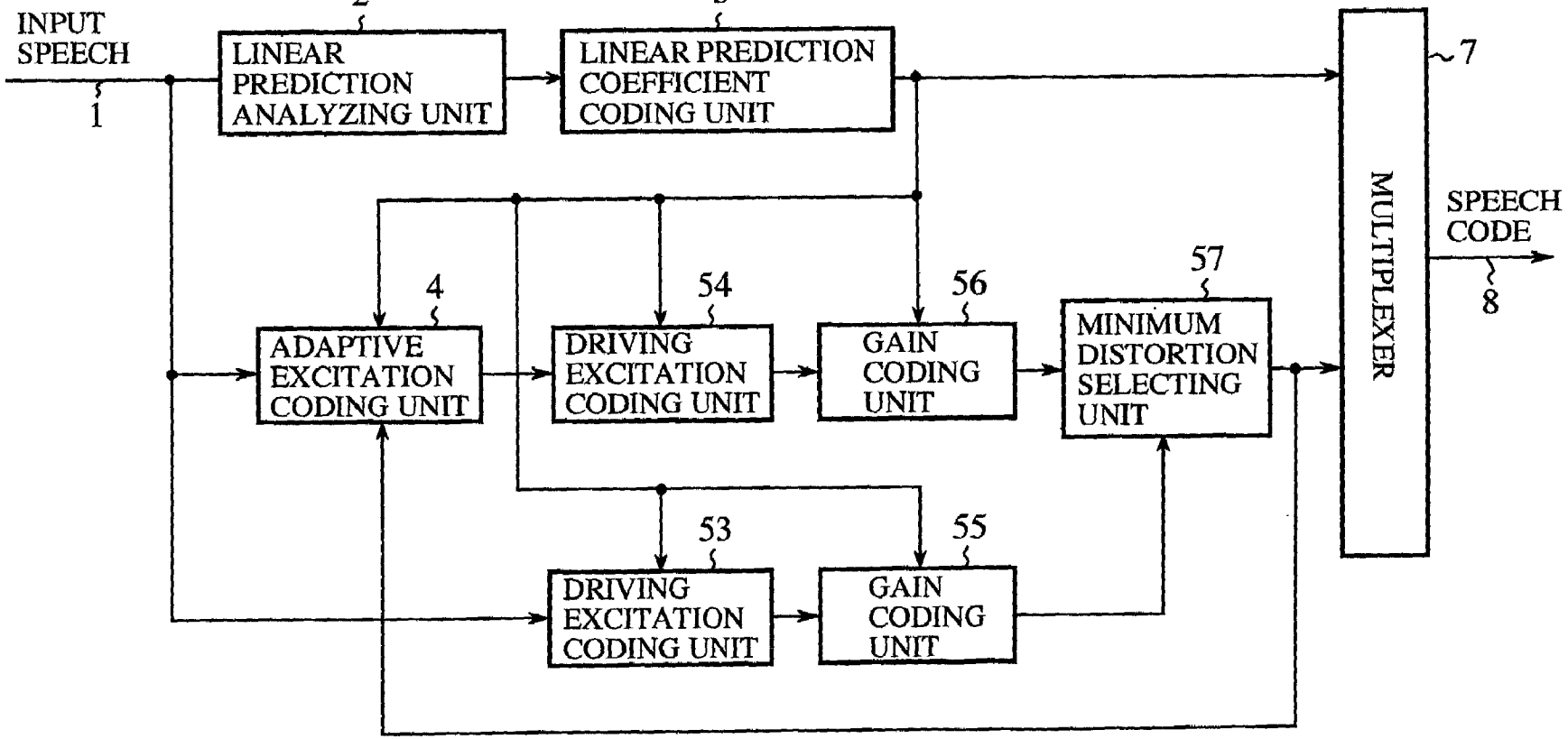
FIG.9 (PRIOR ART)
FIG. 9 is a block diagram showing a configuration of another conventional speech coding apparatus.

Next, the reason that the present embodiment 1 can improve the subjective quality, that is, the quality of the decoded speech obtained by decoding the resultant speech code 8 by the speech decoding apparatus will be described with reference to FIG. 7. FIG. 7 is a conceptual drawing showing waveforms for illustrating the selection of the excitation mode to minimize the coding distortion: FIG. 7(*a*) illustrates the input speech; FIG. 7(*b*) illustrates the decoded speech (result of decoding the speech code by the speech decoding apparatus) when the excitation mode that is prepared to express noisy speech is selected; and FIG. 7(*c*) illustrates the decoded speech when the excitation mode that is prepared to express vowel-like speech is selected. The input speech as illustrated in FIG. 7(*a*) is a speech segment with a noisy characteristic, including large and small amplitude portions mixed in a frame.

Because the modeling does not function satisfactorily when the input speech 1 is noisy as illustrated in FIG. 7(*a*), the distortion ratio in the encoding becomes rather large either in the case of FIG. 7(*b*) that utilizes the excitation mode prepared to express noisy speech (excitation mode using the noisy excitation codeword), or in the case of FIG. 7(*c*) that utilizes the excitation mode prepared to express vowel-like speech (the excitation mode using the non-noisy excitation codeword).

Here, the driving excitation coding unit 9 employs the time-series vectors generated from random numbers, and corresponds to the excitation mode prepared to express the noisy speech as illustrated in FIG. 7(*b*). In contrast, the driving excitation coding units 10 and 11 employ a pulse excitation and pitch filtering corresponding to the excitation mode prepared to express the vowel-like speech as illustrated in FIG. 7(*c*).

As described above, although all distortions D the individual driving excitation coding units 9–11 output are large, only the distortion D the driving excitation coding unit 9 outputs is replaced by the threshold value $D_{th}$ which is smaller than the distortion D by the converter 16. As a result, the minimum distortion selecting unit 17 selects the excitation code the driving excitation coding unit 9 outputs, thereby producing the decoded speech as shown in FIG. 7(*b*). Thus, even when the distortion of the decoded speech as illustrated in FIG. 7(*b*) is greater than that of the decoded speech as illustrated in FIG. 7(*c*), the decoded speech as illustrated in FIG. 7(*b*) is selected consistently in a segment in which the distortion ratio in the coding is large such as in the noisy segment.

In the present embodiment 1, the converter 16 carries out the replacement only when the deciding unit 14 makes a decision that the portion of the speech is other than the onset. This is because if the converter 16 carries out the replacement even in the onset of speech to make the decoded speech as shown in FIG. 7(*b*), the pulse-like characteristics of plosives can be corrupted, or the onsets of vowels are degraded to harsh speech quality.

In the present embodiment 1, the power calculating unit 12 calculates the signal power of the input speech 1, and the threshold calculating unit 13 calculates the threshold value using the signal power. Multiplying the signal power of the input speech 1 by a constant associated with the distortion ratio enables the threshold value to be calculated in terms of a value that will give a fixed distortion ratio (such as SN ratio). Using the threshold value facilitates the selection of the distortion output from the driving excitation coding unit 9 because the distortion value of the driving excitation coding unit 9 is replaced when its distortion exceeds the fixed distortion ratio (such as SN ratio).

As for the threshold calculating unit 13, a modified configuration is also possible that outputs the fixed threshold value R directly without using the signal power of the input speech 1. In this case, the effects similar to those of the present embodiment can be achieved by causing the individual driving excitation coding units 9–11 to output the distortion ratios, that is, the values obtained by dividing their distortions by the signal power P of the input speech 1, instead of the distortions themselves.

Furthermore, although the present embodiment 1 is configured such that the power calculating unit 12 calculates the signal power of the input speech 1, it can be varied to calculate the signal power of the target signal to be encoded the adaptive excitation coding unit 4 outputs. In this case, the threshold value output by the threshold calculating unit 13 becomes the threshold value associated with the distortion of the target signal to be encoded rather than threshold value associated with the distortion of the input speech 1.

Incidentally, in a steady-state vowel segment, since the encoding by the adaptive excitation is performed well, the target signal to be encoded can sometimes become more noisy than the input speech in low amplitude portions. In the foregoing configuration in which the power calculating unit 12 calculates the signal power of the target signal to be encoded, the threshold value becomes smaller and the replacement of the distortion in the converter 16 is apt to occur more easily. However, in the steady-state vowel segment, it is preferable to select one of the driving excitation coding units 9–11 that will minimize the distortion without carrying out the replacement. Thus, it is necessary for the deciding unit 14 to modify its decision processing to halt the replacement. More specifically, the deciding unit 14 can be configured such that when it detects a vowel segment or the onset of speech, it outputs "0" as the decision result, and "1" otherwise. The vowel segment can be detected by using the magnitude of the pitch period of the input speech 1, or by using intermediate parameters during the encoding in the adaptive excitation coding unit 4.

Although the power calculating unit 12 calculates the signal power of the input speech 1, and the threshold calculating unit 13 calculates the threshold value using the signal power in the present embodiment 1, this is not essential. For example, a similar result can be achieved by using the amplitude or logarithmic power instead of the signal power and by modifying the equations used in the threshold calculating unit 13.

In addition, although the present embodiment 1 comprises a single driving excitation coding unit for generating the noisy excitation, the driving excitation coding unit 9, and two driving excitation coding units for generating the non-noisy excitation, the driving excitation coding units 10 and 11, this is not essential. For example, it can comprise two or more driving excitation coding units for generating the noisy excitation, or one or more than two driving excitation coding units for generating the non-noisy excitation.

Although the present embodiment 1 is configured such that it replaces the distortion D by the threshold value $D_{th}$ in response to the compared result of the threshold value $D_{th}$ and the distortion D, this is not essential. For example, it is also possible to prepare a function having the threshold value $D_{th}$ and distortion D as its input variables, and to replace the distortion D by the output value of the function.

Furthermore, although the present embodiment 1 adopts the simple squared distance between the signals as the distortion, this is not essential. For example, the perceptually weighted distortion that is used often in a speech coding apparatus is also applicable.

As described above, the present embodiment 1 is configured such that it selects one of the plurality of excitation modes, and when encoding the input speech 1 frame by frame which is a segment with a predetermined length by using the excitation mode selected, it encodes, in the individual excitation modes, the target signal to be encoded which is obtained from the input speech, and that it compares the coding distortions involved in the encoding with the fixed threshold value, or with the threshold value determined in response to the signal power of the target signal to be encoded, and selects the excitation mode in response to the compared result. Thus, it can select the excitation mode with less degradation in the decoded speech even when the coding distortion is large. As a result, the present embodiment 1 can select a favorable excitation mode that will provide better speech quality, thereby offering an advantage of being able to improve the speech quality, that is, the subjective quality of the decoded speech obtained by decoding the resultant speech code by the speech decoding apparatus.

In addition, the present embodiment 1 is configured such that it compares the coding distortion with the threshold value in a predetermined excitation mode, and when the coding distortion is greater than the threshold value, it replaces the coding distortion by the threshold value, and selects the excitation mode corresponding to the minimum coding distortion among the coding distortions of all the excitation modes. Thus, when the coding distortion is large, the excitation mode that replaces the coding distortion is apt to be selected. As a result, the present embodiment 1 can select a favorable excitation mode that will provide better speech quality, thereby offering an advantage of being able improve the subjective quality (speech quality) of the decoded speech obtained by decoding the resultant speech code by the speech decoding apparatus.

Furthermore, the present embodiment 1 sets the threshold value such that the predetermined distortion ratio is maintained to the input speech or the target signal to be encoded. Accordingly, when the distortion ratio involved in the encoding is greater than the predetermined value, the excitation mode with lesser degradation in the decoded speech can be selected. As a result, the present embodiment 1 can select a favorable excitation mode that will provide better speech quality, thereby offering an advantage of being able to improve the subjective quality (speech quality) of the decoded speech obtained by decoding the resultant speech code by the speech decoding apparatus.

Moreover, the present embodiment 1 is configured such that it analyzes the input speech or the target signal to be encoded to decide the aspect of speech, and only when the aspect of speech becomes a predetermined decision result, it selects the excitation mode without using the compared result of the coding distortion with the threshold value. Thus, as for the input speech that will bring about small degradation in the decoded speech even for large coding distortion, the present embodiment 1 carries out the same excitation mode selection as the conventional example. As a result, it can perform more careful excitation mode selection, there by offering an advantage of being able to improve the subjective quality (speech quality) of the decoded speech obtained by decoding the resultant speech code by the speech decoding apparatus.

In addition, the present embodiment 1 is configured such that it makes a decision as to at least whether the aspect of speech is the onset of speech or not. Accordingly, it can change the control of the excitation mode selection in response to the coding distortion at the onset of speech that is likely to provide large coding distortion, or to the coding distortion in the remaining sections. As a result, it can reduce the degradation in the onset of speech, and improve the excitation mode selection in the remaining sections, thereby improving the subjective quality (speech quality) of the decoded speech obtained by decoding the resultant speech code by the speech decoding apparatus. In addition, as for the onset segment of the speech, there is a case where pulse-like excitation is more favorable than noisy excitation as with the plosives. For this reason, the control, which gives priority to a particular excitation mode in the signal mode selection in spite of large coding distortion, sometimes causes degradation. However, the present embodiment 1 offers an advantage of being able to avoid it by making the decision of the onset of speech.

Furthermore, the present embodiment 1 comprises the plurality of excitation modes consisting of the excitation modes that generate the non-noisy excitation and the excitation mode that generates the noisy excitation, so that it can readily select the excitation mode that generates the noisy excitation when the coding distortion is large. As a result, it can avoid selecting the excitation mode that generates the non-noisy excitation in such a case, thereby offering an advantage of being able to improve the subjective quality (speech quality) of the decoded speech obtained by decoding the resultant speech code by the speech decoding apparatus.

Finally, the present embodiment 1 comprises the plurality of excitation modes consisting of the excitation modes that uses the non-noisy excitation codewords and the excitation mode that uses the noisy excitation codewords, so that it can readily select the excitation mode that generates the noisy excitation codewords when the coding distortion is large. As a result, it can avoid selecting the excitation mode that generates the non-noisy excitation codewords in such a case, thereby offering an advantage of being able to improve the subjective quality (speech quality) of the decoded speech obtained by decoding the resultant speech code by the speech decoding apparatus.

Embodiment 2

Figure 2:
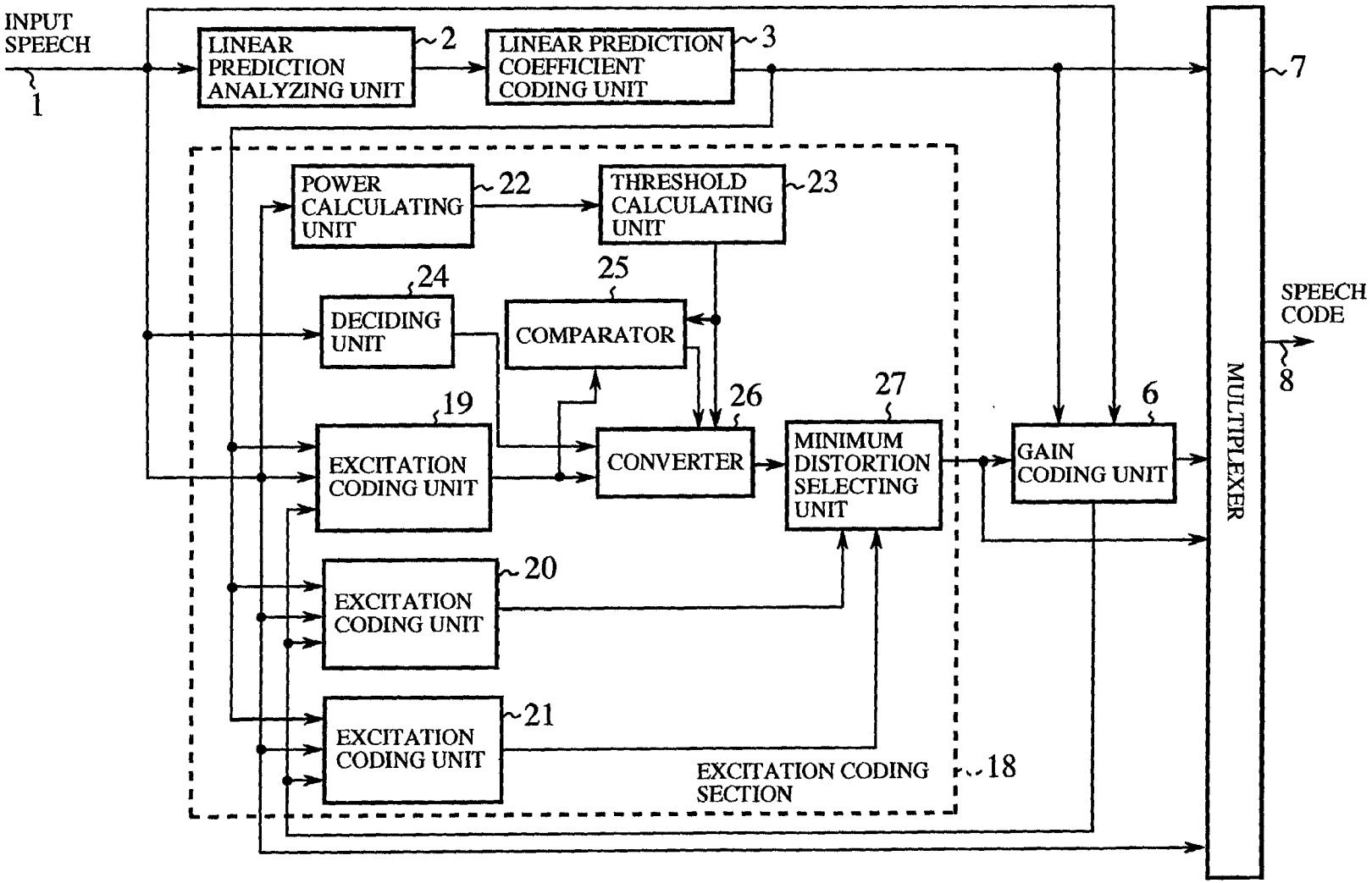
FIG. 2 is a block diagram showing a configuration of a speech coding apparatus employing a speech coding method of an embodiment 2 in accordance with the present invention.

FIG. 2 is a block diagram showing a configuration of a speech coding apparatus employing a speech coding method of an embodiment 2 in accordance with the present invention. In this figure, the reference numeral 1 designates an input speech, 2 designates a linear prediction analyzing unit, 3 designates a linear prediction coefficient coding unit, 6 designates a gain coding unit, 7 designates a multiplexer, and 8 designates a speech code, all of which correspond to the individual components of the embodiment 1 designated by the same reference numerals in FIG. 1.

The reference numeral 18 designates an excitation coding section for generating the adaptive excitation, driving excitation, excitation code and mode selection information from the input speech 1 and the signal from the linear prediction coefficient coding unit 3.

In the excitation coding section 18, the reference numeral 19 designates an excitation coding unit that comprises a driving excitation codebook including time-series vectors generated from random numbers, and generates the excitation code, distortion and driving excitation from the input speech 1 and the signal fed from the linear prediction coefficient coding unit 3 by detecting the distortion between the temporary synthesized signal and the input speech 1. The reference numeral 20 designates an excitation coding unit that comprises a driving excitation codebook including a pulse position table, and generates the excitation code, distortion and driving excitation from the input speech 1 and the signal fed from the linear prediction coefficient coding unit 3 by detecting the distortion between the temporary synthesized signal and the input speech 1. The reference numeral 21 designates an excitation coding unit that comprises an adaptive excitation coding unit having an adaptive excitation codebook, and a driving excitation coding unit having a driving excitation codebook, and generates the excitation code, distortion, adaptive excitation and driving excitation from the input speech 1 and the signal fed from the linear prediction coefficient coding unit 3.

The reference numeral 22 designates a power calculating unit for calculating the signal power of the input speech; 23 designates a threshold calculating unit for calculating the threshold value associated with the distortion from the signal fed from the power calculating unit 22; and 24 designates a deciding unit for deciding as to whether the input speech is the onset of speech or not by analyzing the input speech 1. The reference numeral 25 designates a comparator for comparing the signal fed from the excitation coding unit 19 with the threshold value fed from the threshold calculating unit 23. The reference numeral 26 designates a converter for converting the output of the excitation coding unit 19 in response to the decision result of the deciding unit 24 and the compared result of the comparator 25. The reference numeral 27 designates a minimum distortion selecting unit for supplying the gain coding unit 6 with the adaptive excitation and driving excitation, and the multiplexer 7 with the excitation code and mode selection information, in response to the signal from the converter 26 and the signals from the excitation coding units 20 and 21.

Thus, the present embodiment 2 differs from the foregoing embodiment 1 which selects one of the plurality of driving excitation coding units 9–11 in that the present embodiment 2 selects one of the plurality of excitation coding units 19–21. In other words, the present embodiment 2 applies the present invention to the selection of the more general excitation coding units 19–21, each of which includes the adaptive excitation coding unit in addition to the excitation coding unit.

Next, the operation of the present embodiment 2 will be described with reference to FIG. 2 with placing emphasis on the portions different from those of the foregoing embodiment 1.

First, the input speech 1 is supplied to the linear prediction analyzing unit 2, gain coding unit 6 and excitation coding section 18. Receiving the input speech 1, the linear prediction analyzing unit 2 analyzes it to extract the linear prediction coefficients constituting the spectrum envelope information of the speech, and supplies them to the linear prediction coefficient coding unit 3. The linear prediction coefficient coding unit 3 encodes the linear prediction coefficients from the linear prediction analyzing unit 2 and supplies the encoded result to the multiplexer 7. It also supplies the linear prediction coefficients quantized for the encoding of the excitation to the excitation coding section 18 and gain coding unit 6. Here, in the excitation coding section 18, the input speech 1 is supplied to the excitation coding units 19–21, power calculating unit 22 and deciding unit 24, and the quantized linear prediction coefficients from the linear prediction coefficient coding unit 3 is supplied to the excitation coding units 19–21.

In the excitation coding unit 19, the driving excitation codebook stores the time-series vectors generated from random numbers as noisy excitation codewords. The driving excitation codebook in the excitation coding unit 19, receiving the excitation code represented by a binary number of a few bits, reads the time-series vector stored at the position corresponding to the excitation code, and outputs it. The time-series vector thus output constitutes the noisy excitation. The excitation coding unit 19 obtains the temporary synthesized signal by filtering the time-series vector, which is obtained by supplying each excitation code to the driving excitation codebook, through a synthesis filter that uses the quantized linear prediction coefficients supplied from the linear prediction coefficient coding unit 3. Then, it calculates the difference between the input speech 1 and a signal obtained by multiplying the resultant temporary synthesized signal by an appropriate gain to detect the distortion between them.

The excitation coding unit 19 performs this processing on all the excitation codes. Thus, it selects the excitation code that gives the minimum distortion, and adopts the time-series vector corresponding to the selected excitation code as the driving excitation. At the same time, it supplies the comparator 15 and converter 16 with the driving excitation along with the minimum distortion and excitation code.

The excitation coding unit 20 stores the driving excitation codebook including a pulse position table. The driving excitation codebook in the driving excitation coding unit 20, receiving the excitation code represented by a binary number of a few bits, divides the excitation code into plural pulse position codes and plural polarities, reads the pulse positions stored in the positions corresponding to the individual pulse position codes in the pulse position table, and outputs a time-series vector having a plurality of pulses in response to the pulse positions and polarities. Thus, the time-series vector constitutes non-noisy excitation consisting of a plurality of pulses. The driving excitation codebook is considered to store the non-noisy excitation codewords in the form of the pulse position table.

The excitation coding unit 20 obtains the temporary synthesized signal by filtering the time-series vector, which is obtained by inputting the individual excitation codes to the driving excitation codebook, through the synthesis filter that uses the quantized linear prediction coefficients output from the linear prediction coefficient coding unit 3. Then, it calculates the difference between the input speech 1 and a signal obtained by multiplying the resultant temporary synthesized signal by an appropriate gain to detect the distortion between them.

The excitation coding unit 20 performs this processing on all the excitation codes, selects the excitation code that gives the minimum distortion, and adopts the time-series vector corresponding to the selected excitation code as the driving excitation. Then, it supplies the driving excitation to the minimum distortion selecting unit 17 along with the minimum distortion and excitation code.

The excitation coding unit 21 comprises an adaptive excitation coding unit that stores previous excitation with a predetermined length as an adaptive excitation codebook, and a driving excitation coding unit that stores a driving excitation codebook including a pulse position table. The adaptive excitation codebook of the adaptive excitation coding unit in the excitation coding unit 21, receiving an adaptive excitation code represented in a binary number of a few bits, calculates the repetition period from the adaptive excitation code, generates a time-series vector that cyclically repeats the previous excitation by using the repetition period, and outputs the time-series vector. In addition, the driving excitation codebook of the driving excitation coding unit in the excitation coding unit 21, receiving the driving excitation code represented by a binary number of a few bits, reads the time-series vector stored at the position corresponding to the driving excitation code, and outputs it. The time-series vector generates non-noisy excitation consisting of a plurality of pulses, and the driving excitation codebook is considered to store the non-noisy excitation codewords in the form of the pulse position table.

The adaptive excitation coding unit of the excitation coding unit 21 obtains a temporary synthesized signal by filtering the individual time-series vectors, which are obtained by inputting the individual adaptive excitation codes to the adaptive excitation codebook of the adaptive excitation coding unit, through a synthesis filter that uses the quantized linear prediction coefficients supplied from the linear prediction coefficient coding unit 3. Then, it detects a distortion between the input speech 1 and a signal obtained by multiplying the resultant temporary synthesized signal by an appropriate gain. Performing this processing on all the excitation codes, the adaptive excitation coding unit of the excitation coding unit 21 selects the adaptive excitation code that gives the minimum distortion, and outputs the time-series vector corresponding to the selected adaptive excitation code as an adaptive excitation. It also calculates the difference between the input speech 1 and a signal obtained by multiplying the synthesized signal using the adaptive excitation by an appropriate gain, and outputs the difference as the target signal to be encoded.

The driving excitation coding unit of the excitation coding unit 21 obtains the temporary synthesized signal as follows. First, it conducts the pitch filtering of the time-series vector, which is obtained by inputting the driving excitation code to the driving excitation codebook, by using the repetition period corresponding to the adaptive excitation code selected by the adaptive excitation coding unit in the excitation coding unit 21. Subsequently, it filters the time-series vector through the synthesis filter that uses the quantized linear prediction coefficients output from the linear prediction coefficient coding unit 3, thereby obtaining the temporary synthesized signal. Then, it detects the distortion between the signal which is obtained by multiplying the resultant temporary synthesized signal by an appropriate gain and the target signal to be encoded which is supplied from the adaptive excitation coding unit. The driving excitation coding unit in the excitation coding unit 21 performs this processing on all the driving excitation codes, selects the driving excitation code that gives the minimum distortion, and adopts the time-series vector corresponding to the selected driving excitation code as the driving excitation. Then, it outputs the driving excitation along with the minimum distortion and driving excitation code.

Finally, the excitation coding unit 21 multiplexes the adaptive excitation code and the driving excitation code, and supplies the minimum distortion selecting unit 27 with the resultant excitation code along with the adaptive excitation and the driving excitation.

The power calculating unit 22 calculates the signal power in each frame of the input speech 1 provided thereto, and supplies the resultant signal power to the threshold calculating unit 23. The threshold calculating unit 23 multiplies the signal power fed from the power calculating unit 22 by a constant associated with the distortion ratio prepared in advance, and supplies the calculation result to the comparator 25 and converter 26 as the threshold value associated with the distortion. The deciding unit 24 analyzes the input speech 1 it receives, and decides the aspect of speech. As a result, when the decision result indicates the onset of speech, it outputs "0", and otherwise "1" as the decision result.

The comparator 25 compares the distortion supplied from the excitation coding unit 19 with the threshold value associated with the distortion supplied from the threshold calculating unit 23, and outputs "1" when the distortion is greater than the threshold value, and otherwise "0". Receiving the decision result from the deciding unit 24 and the compared result from the comparator 25, the converter 26 replaces, when both of them are "1", the distortion fed from the excitation coding unit 19 by the threshold value fed from the threshold calculating unit 23. The converter 26 does not carry out the replacement when at least one of the decision result of the deciding unit 24 and the compared result of the comparator 25 is "0". The result of the replacement by the converter 26 is supplied to the minimum distortion selecting unit 27.

The minimum distortion selecting unit 27 compares the three distortions supplied from the converter 26 and excitation coding units 20 and 21, and selects the minimum distortion among them. When the minimum distortion selecting unit 27 selects the distortion fed from the converter 26, it supplies the gain coding unit 6 with a signal the entire elements of which are zero as the adaptive excitation, and with the driving excitation fed from the converter 26, and supplies the multiplexer 7 with the excitation code fed from the converter 26. When the minimum distortion selecting unit 27 selects the distortion fed from the excitation coding unit 20, it supplies the gain coding unit 6 with a signal the entire elements of which are zero as the adaptive excitation, and with the driving excitation fed from the excitation coding unit 20, and supplies the multiplexer 7 with the excitation code fed from the excitation coding unit 20. When the minimum distortion selecting unit 27 selects the distortion fed from the excitation coding unit 21, it supplies the gain coding unit 6 with the adaptive excitation and the driving excitation fed from the excitation coding unit 21, and supplies the multiplexer 7 with the excitation code fed from the excitation coding unit 21. In addition, the minimum distortion selecting unit 27 supplies the multiplexer 7 with the information about which one of the three distortions it selects as the mode selection information.

The gain coding unit 6 stores a plurality of gain vectors as a gain codebook, each of the gain vectors representing two gain values associated with the adaptive excitation and driving excitation. The gain codebook, receiving again code represented by a binary number of a few bits, reads the gain vector stored in the position corresponding to the gain code, and outputs it. The gain coding unit 6 obtains the gain vector by supplying the gain codebook with each gain code, and generates a temporary excitation by multiplying its first element by the adaptive excitation fed from the driving excitation coding section 18, by multiplying its second element by the driving excitation fed from the driving excitation coding section 18, and by adding the resultant two signals. Then, it obtains the temporary synthesized signal by filtering the temporary excitation through the synthesis filter that uses the quantized linear prediction coefficients supplied from the linear prediction coefficient coding unit 3. Subsequently, it calculates the difference between the resultant temporary synthesized signal and the input speech 1 to detect the distortion between them.

The gain coding unit 6 performs this processing on all the gain codes, selects the gain code that gives the minimum distortion, and supplies the multiplexer 7 with the selected gain code. It also supplies the adaptive excitation coding unit in the excitation coding unit 21 with the temporary excitation corresponding to the selected gain code as the final excitation.

The adaptive excitation coding unit in the excitation coding unit 21, receiving the final excitation from the gain coding unit 6, updates its adaptive excitation codebook in response to the final excitation.

Subsequently, the multiplexer 7 multiplexes the linear prediction coefficient code supplied from the linear prediction coefficient coding unit 3, the excitation code and mode selection information fed from the driving excitation coding section 18, and the gain code fed from the gain coding unit 6, and outputs the resultant speech code 8.

Although the present embodiment 2 is described by way of example of the configuration as shown in FIG. 2 that comprises a plurality of higher level excitation coding units each including the adaptive excitation coding unit, and selects one of them, various modifications are possible. For example, as the speech coding apparatus of the foregoing embodiment 1, the speech coding apparatus can be configured such that it comprises a plurality of driving excitation coding units, and selects one of them.

As described above, the present embodiment 2 comprises a plurality of higher level excitation coding units each including the adaptive excitation coding unit, and selects one of them. As a result, it can offer the same advantages as the foregoing embodiment 1 in selecting the excitation coding units.

Embodiment 3

Figure 3:
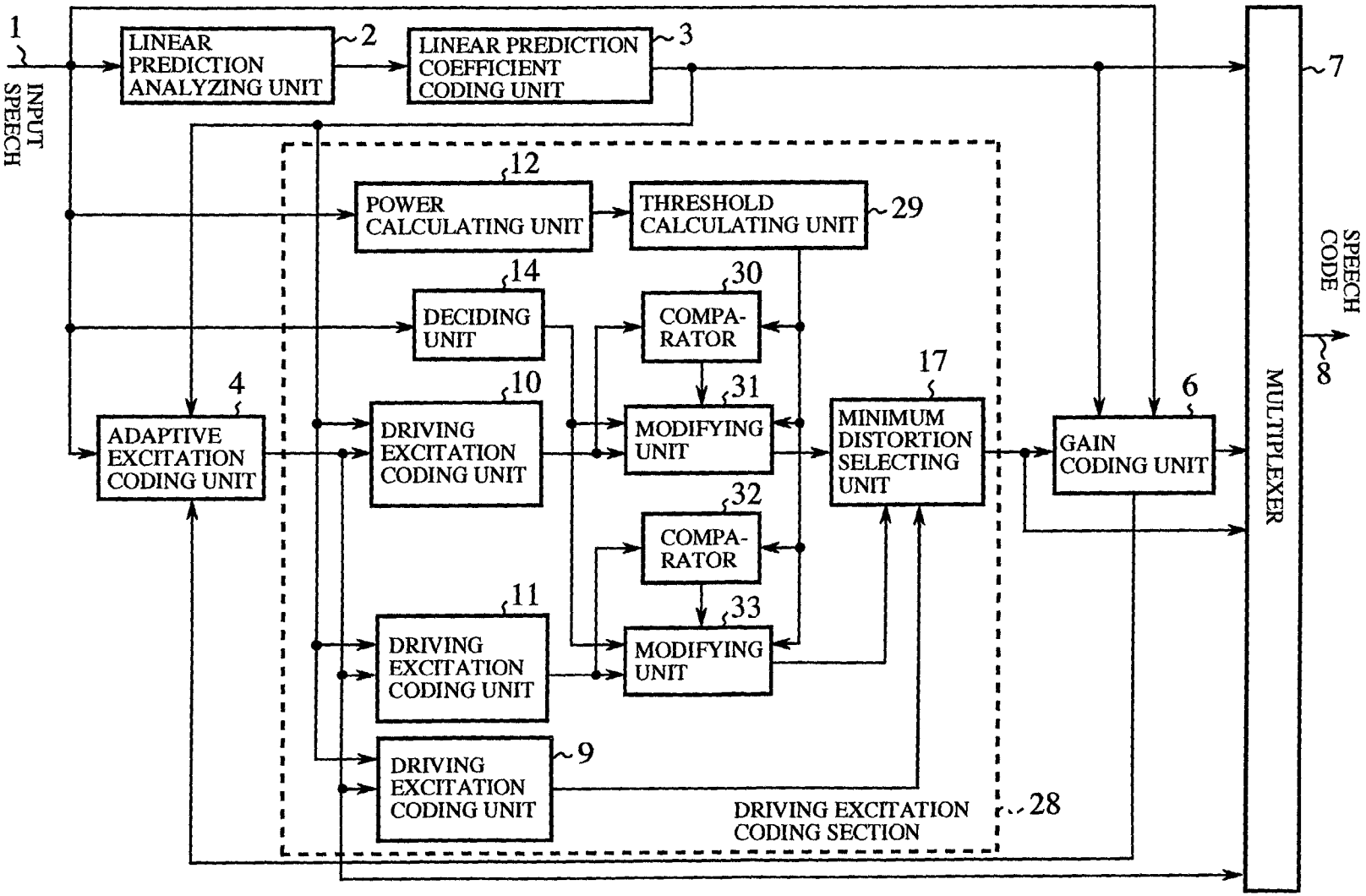
FIG. 3 is a block diagram showing a configuration of a speech coding apparatus employing a speech coding method of an embodiment 3 in accordance with the present invention.

FIG. 3 is a block diagram showing a configuration of a speech coding apparatus utilizing a speech coding method of an embodiment 3 in accordance with the present invention. In this figure, the same or like portions to those of FIG. 1 are designated by the same reference numerals, and the description thereof is omitted here. In FIG. 3, the reference numeral 28 designates a driving excitation coding section for generating a driving excitation, a driving excitation code and mode selection information from an input speech 1, a signal fed from the linear prediction coefficient coding unit 3 and a signal fed from the adaptive excitation coding unit 4.

The reference numeral 29 designates a threshold calculating unit for calculating a first threshold value and a second threshold value associated with the distortion from the signal fed from the power calculating unit 12. The reference numeral 30 designates a comparator for comparing the signal fed from the driving excitation coding unit 10 with the first threshold value; and 31 designates a modifying unit as a converter for modifying the output of the driving excitation coding unit 10 in response to the decision results of the comparator 30 and deciding unit 14. The reference numeral 32 designates a comparator for comparing the signal fed from the driving excitation coding unit 11 with the second threshold value; and 33 designates a modifying unit as a converter for modifying the output of the driving excitation coding unit 11 in response to the decision results of the comparator 32 and deciding unit 14. The driving excitation coding section 28 comprises the threshold calculating unit 29, comparators 30 and 32, modifying units 31 and 33, driving excitation coding units 9, 10 and 11, power calculating unit 12, deciding unit 14, and minimum distortion selecting unit 17.

Next, the operation of the present embodiment 3 will be described with reference to FIG. 3 with placing emphasis on the portions different from those of the foregoing embodiment 1.

In this case also, the linear prediction coefficients quantized by the linear prediction coefficient coding unit 3 and the target signal to be encoded fed from the adaptive excitation coding unit 4 are supplied to the driving excitation coding units 9–11 in the driving excitation coding section 28. The driving excitation coding unit 9 stores a plurality of time-series vectors generated from random numbers as a driving excitation codebook. As in the foregoing embodiment 1, the driving excitation coding unit 9 selects the driving excitation code that will minimize the distortion involved in encoding the target signal to be encoded fed from the adaptive excitation coding unit 4 by using the driving excitation codebook, and supplies the minimum distortion selecting unit 17 with the time-series vector corresponding to the selected driving excitation code as the driving excitation along with the minimum distortion and the driving excitation code.

The driving excitation coding unit 10 stores a driving excitation codebook including a pulse position table. Using the driving excitation codebook, the driving excitation coding unit 10 selects the driving excitation code that will minimize the distortion involve din encoding the target signal to be encoded fed from the adaptive excitation coding unit 4 as in the foregoing embodiment 1, and supplies the comparator 30 and modifying unit 31 with the time-series vector corresponding to the selected driving excitation code as the driving excitation along with the minimum distortion and driving excitation code. Likewise, the driving excitation coding unit 11 stores a driving excitation codebook including a pulse position table different from that of the driving excitation coding unit 10. Using the driving excitation codebook, the driving excitation coding unit 11 selects the driving excitation code that will minimize the distortion involved in encoding the target signal to be encoded fed from the adaptive excitation coding unit 4, and supplies the comparator 32 and modifying unit 33 with the time-series vector corresponding to the selected driving excitation code as the driving excitation along with the minimum distortion and driving excitation code.

In this case, the driving excitation codebook of the driving excitation coding unit 9 stores the noisy excitation codewords generated from random numbers. In contrast, the driving excitation codebooks of the driving excitation coding units 10 and 11 comprise non-noisy excitation codewords based on the pulse position table or the like. Furthermore,the time-series vectors output from the driving excitation coding unit 9 generate the noisy excitation, and the time-series vectors output from the driving excitation coding units 10 and 11 generate the non-noisy excitation.

The threshold calculating unit 29 obtains the first threshold value associated with the distortion by multiplying the signal power calculated by the power calculating unit 12 by the first constant associated with the distortion ratio, and the second threshold value associated with the distortion by multiplying the signal power by the second constant associated with the distortion ratio. The resultant first threshold value associated with the distortion is supplied to the comparator 30 and modifying unit 31, and the second threshold value associated with the distortion is supplied to the comparator 32 and modifying unit 33. As for the constants associated with the first and second distortion ratios which are prepared in advance, one of them that has greater degradation in the decoded speeches of the driving excitation coding units 10 and 11 is set smaller than the other when the coding distortion is large. The smaller the constant associated with the distortion ratio, the smaller the coding distortion at which the compared result of the comparator 30 or 32, which will be described below, becomes "1".

The deciding unit 14 analyzes the input speech 1 to decide the aspect of speech as in the embodiment 1. As a result, when it is the onset of speech, the deciding unit 14 outputs "0", and otherwise "1".

Comparing the distortion fed from the driving excitation coding unit 10 with the first threshold value fed from the threshold calculating unit 29, the comparator 30 outputs "1" when the distortion is greater than the first threshold value, and otherwise "0" as the compared result. When the decision result output from the deciding unit 14 and the compared result output from the comparator 30 are both "1", the modifying unit 31 modifies the resultant distortion of the output of the driving excitation coding unit 10 by using the first threshold value fed from the threshold calculating unit 29, and supplies the modified value to the minimum distortion selecting unit 17 as a new distortion. In the other cases, the distortion output from the driving excitation coding unit 10 is supplied immediately to the minimum distortion selecting unit 17 without change. The modifying unit 31 can achieve the modification by the following equation (6).

$$D'=D+\alpha(D-D_{th}) \tag{6}$$

where D is the distortion, $D_{th}$ is the threshold value, D' is the distortion after the modification, and $\alpha$ is a positive constant.

Incidentally, the modifying unit 31 can perform the modification by using a more complicated modification scheme than equation (6) such as using an exponential function, or can convert the distortion to a very large fixed value. In the latter case, the minimum distortion selecting unit 17 cannot select the driving excitation coding unit 10 principally.

Comparing the distortion fed from the driving excitation coding unit 11 with the second threshold value fed from the threshold calculating unit 29, the comparator 32 outputs "1" when the distortion is greater than the second threshold value, and otherwise "0" as the compared result. When the decision result output from the deciding unit 14 and the compared result output from the comparator 32 are both "1", the modifying unit 33 modifies the resultant distortion of the output of the driving excitation coding unit 11 by using the second threshold value fed from the threshold calculating unit 29, and supplies the modified value to the minimum distortion selecting unit 17 as a new distortion. In the other cases, the distortion output from the driving excitation coding unit 11 is supplied immediately to the minimum distortion selecting unit 17 without change. The modifying unit 33 can achieve the modification in the same manner as the modifying unit 31.

The minimum distortion selecting unit 17 compares the individual distortions fed from the driving excitation coding unit 9 and modifying units 31 and 33, and selects the minimum distortion among them. As a result, when the minimum distortion selecting unit 17 selects the distortion fed from the driving excitation coding unit 9, it supplies the driving excitation fed from the driving excitation coding unit 9 to the gain coding unit 6, and the driving excitation code to the multiplexer 7. When the minimum distortion selecting unit 17 selects the distortion fed from the modifying unit 31, it supplies the driving excitation and the driving excitation code fed from the driving excitation coding unit 10 via the modifying unit 31 to the gain coding unit 6 and the multiplexer 7, respectively. Likewise, when the minimum distortion selecting unit 17 selects the distortion fed from the modifying unit 33, it supplies the driving excitation and the driving excitation code fed from the driving excitation coding unit 11 via the modifying unit 33 to the gain coding unit 6 and the multiplexer 7, respectively. In addition, it supplies the multiplexer 7 with the information about which one of the three distortions it selects as the mode selection information.

Next, the reason that the present embodiment 3 can improve the subjective quality, that is, the quality of the speech obtained by decoding the resultant speech code 8 by the speech decoding apparatus will be described with reference to FIG. 7.

FIG. 7 is a conceptual drawing showing waveforms for illustrating the selection of the excitation mode to minimize the coding distortion: FIG. 7(*a*) illustrates the input speech; FIG. 7(*b*) illustrates the decoded speech when the excitation mode that is prepared to express noisy speech is selected; and FIG. 7(*c*) illustrates the decoded speech when the excitation mode that is prepared to express vowel-like speech is selected. Because the modeling does not function satisfactorily when the input speech 1 is noisy as illustrated in FIG. 7(*a*), the distortion ratio in the encoding becomes rather large either in the case of FIG. 7(*b*) that utilizes the excitation mode prepared to express noisy speech, or in the case of FIG. 7(*c*) that utilizes the excitation mode prepared to express vowel-like speech.

Here, the driving excitation coding unit 9, which corresponds to the excitation mode prepared to express the noisy speech as illustrated in FIG. 7(*b*), employs the time-series vectors generated from random numbers. In contrast, the driving excitation coding units 10 and 11, which correspond to the excitation mode prepared to express the vowel-like speech as illustrated in FIG. 7(*c*), employ a pulse excitation and pitch filtering.

Although all the distortions D the individual driving excitation coding units 9–11 output are large, the distortions D the driving excitation coding units 10 and 11 output are changed to a value greater than the distortions D by the modifying units 31 and 33. As a result, the minimum distortion selecting unit 17 selects the driving excitation code the driving excitation coding unit 9 outputs, thereby producing the decoded speech as shown in FIG. 7(*b*). Thus, even when the distortion of the decoded speech as illustrated in FIG. 7(*b*) is greater than that of the decoded speech as illustrated in FIG. 7(*c*), the decoded speech as illustrated in FIG. 7(*b*) is selected consistently in a segment in which the distortion ratio of the encoding is large such as in the noisy segment.

Although the present embodiment 3 is described by way of example in which the individual driving excitation coding units 9–11 search for the driving excitation code that will minimize the distortion D of the foregoing equation (1), and output the minimum distortion D, this is not essential. For example, as the embodiment 1, such a configuration is possible that searches for the driving excitation code that will maximize the evaluation value d of the foregoing equation (3), and output the evaluation value d instead of the distortion D.

In addition, the present embodiment 3 can be modified such that the threshold calculating unit 29 outputs the two fixed threshold values, and the individual driving excitation coding units 9–11 can output the distortion ratios, that is, the values obtained by dividing their distortions by the signal power of the input speech 1. Furthermore, it can be modified such that the power calculating unit 12 calculates the signal power of the target signal to be encoded supplied from the adaptive excitation coding unit 4, or calculates the amplitude or logarithmic power instead of the signal power.

In addition, although the present embodiment 3 comprises a single driving excitation coding unit for generating the noisy excitation, the driving excitation coding unit 9, and two driving excitation coding units for generating the non-noisy excitation, the driving excitation coding units 10 and 11, this is not essential. For example, it can comprise two or more driving excitation coding units for generating the noisy excitation, or one or more than two driving excitation coding units for generating the non-noisy excitation.

Furthermore, although the present embodiment 3 adopts the simple squared distance between the signals as the distortion, this is not essential. For example, the perceptually weighted distortion that is used often in a speech coding apparatus is also applicable.

As described above, the present embodiment 3 can select the excitation mode with lesser degradation in the decoded speech, even when the coding distortion is large or the distortion ratio involved in the encoding is greater than a predetermined value. Besides, as for the input speech that will bring about small degradation in the decoded speech even for large coding distortion, since the present embodiment 3 carries out the same excitation mode selection as the conventional example, it can achieve more careful selection of the excitation mode. In addition, since it can change the control of the excitation mode selection based on the coding distortion for the sections of speech that are likely to provide large coding distortion, or for the remaining sections, it can reduce the degradation in the onset of speech, and improve the excitation mode selection in the remaining sections. Furthermore, when the coding distortion is large, the present embodiment can facilitate selecting the excitation mode that will generate the noisy excitation, or the excitation mode that uses the noisy excitation codes, thereby preventing the degradation caused by selecting the excitation mode that generates the non-noisy excitation or the excitation mode that uses the non-noisy excitation codes. Thus, the present embodiment 3 can select the favorable excitation mode that will provide a better speech quality, thereby offering an advantage of being able to improve the subjective quality (speech quality) of the decoded speech obtained by decoding the resultant speech code.

In addition, the present embodiment 3 can prevent the selection of the excitation mode that will provide the compared result that the coding distortion exceeds the threshold value. As a result, when the coding distortion is large, the present embodiment 3 can facilitate selecting the excitation mode with less quality degradation in the decoded speech. Thus, the present embodiment 3 can select the favorable excitation mode that will provide a better speech quality, thereby offering an advantage of being able to improve the subjective quality (speech quality) of the decoded speech obtained by decoding the resultant speech code.

Finally, the present embodiment 3 prepares the threshold value for each excitation mode. Thus, it can select a favorable excitation mode that will provide better speech quality by adjusting the threshold value for detecting the degradation in the decoded speech quality for each excitation mode, thereby offering an advantage of being able to improve the subjective quality (speech quality) of the decoded speech obtained by decoding the resultant speech code.

Embodiment 4

Figure 4:
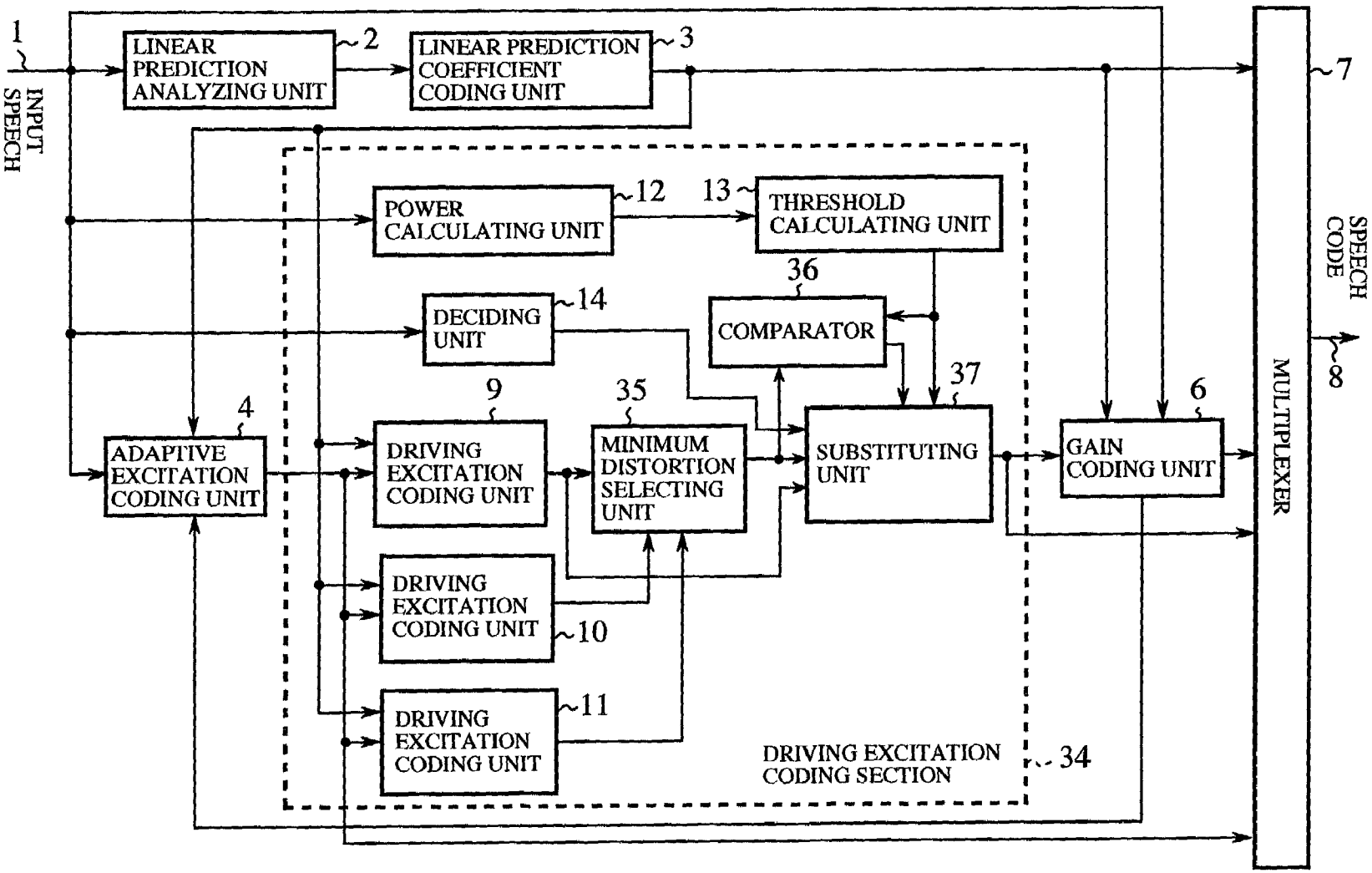
FIG. 4 is a block diagram showing a configuration of a speech coding apparatus employing a speech coding method o f an embodiment 4 in accordance with the present invention.

FIG. 4 is a block diagram showing a configuration of a speech coding apparatus employing a speech coding method of an embodiment 4 in accordance with the present invention. In this figure, the same or like portions to those of FIG. 1 are designated by the same reference numerals, and the description thereof is omitted here. In FIG. 4, the reference numeral 34 designates a driving excitation coding section for generating a driving excitation, driving excitation code and mode selection information from the input speech 1, the signal from the linear prediction coefficient coding unit 3 and the signal from the adaptive excitation coding unit 4.

The reference numeral 35 designates a minimum distortion selecting unit for outputting a minimum distortion, and a driving excitation, driving excitation code and mode selection information corresponding to the minimum distortion in response to the signals fed from the driving excitation coding units 9–11. The reference numeral 36 designates a comparator for comparing the minimum distortion fed from the minimum distortion selecting unit 35 with the threshold value fed from the threshold calculating unit 13; and 37 designates a substituting unit for replacing the driving excitation and driving excitation code fed from the minimum distortion selecting unit 35 by the output of the driving excitation coding unit 9 in response to the decision results of the comparator 36 and deciding unit 14. Here, the driving excitation coding section 34 comprises the minimum distortion selecting unit 35, comparator 36, substituting unit 37, driving excitation coding units 9, 10 and 11, power calculating unit 12, threshold calculating unit 13 and deciding unit 14.

Next, the operation of the present embodiment 4 will be described with reference to FIG. 4 with placing emphasis on the portions different from those of the foregoing embodiment 1.

In this case also, the linear prediction coefficients quantized by the linear prediction coefficient coding unit 3 and the target signal to be encoded fed from the adaptive excitation coding unit 4 are supplied to the driving excitation coding units 9–11 in the driving excitation coding section 34. The driving excitation coding unit 9 stores a plurality of time-series vectors generated from random numbers as a driving excitation codebook. As in the foregoing embodiment 1, the driving excitation coding unit 9 selects the driving excitation code that will minimize the distortion involved in encoding the target signal to be encoded fed from the adaptive excitation coding unit 4 by using the driving excitation codebook, and supplies the minimum distortion selecting unit 35 and substituting unit 37 with the time-series vector corresponding to the selected driving excitation code as the driving excitation along with the minimum distortion and the driving excitation code.

The driving excitation coding unit 10 stores a driving excitation codebook including a pulse position table. Using the driving excitation codebook, the driving excitation coding unit 10 selects the driving excitation code that will minimize the distortion involved in encoding the target signal to be encoded fed from the adaptive excitation coding unit 4, and supplies the minimum distortion selecting unit 35 with the time-series vector corresponding to the selected driving excitation code as the driving excitation along with the minimum distortion and driving excitation code. Likewise, the driving excitation coding unit 11 stores a driving excitation codebook including a pulse position table different from that of the driving excitation coding unit 10. Using the driving excitation codebook, the driving excitation coding unit 11 selects the driving excitation code that will minimize the distortion involved in encoding the target signal to be encoded fed from the adaptive excitation coding unit 4, and supplies the minimum distortion selecting unit 35 with the time-series vector corresponding to the selected driving excitation code as the driving excitation along with the minimum distortion and driving excitation code.

In this case, the driving excitation codebook of the driving excitation coding unit 9 stores the noisy excitation codewords generated from random numbers. In contrast, the driving excitation codebooks of the driving excitation coding units 10 and 11 comprise non-noisy excitation codewords based on the pulse position table or the like. Here, the time-series vectors output from the driving excitation coding unit 9 generate noisy excitation, and the time-series vectors output from the driving excitation coding units 10 and 11 generate non-noisy excitation.

The minimum distortion selecting unit 35 compares the individual distortions fed from the individual driving excitation coding units 9–11, selects the minimum distortion among them, and supplies the minimum distortion to the comparator 36. It also supplies the substituting unit 37 with the driving excitation and driving excitation code corresponding to the minimum distortion fed from one of the driving excitation coding units 9–11, along with the mode selection information indicating which one of the three distortions is selected. The deciding unit 14 decides the aspect of speech of the input speech 1 by analyzing it, and supplies the substituting unit 37 with "0" when it is the onset of speech, and with "1" otherwise.

On the other hand, the comparator 36 is supplied with the distortion the minimum distortion selecting unit 35 selects, and with the threshold value associated with the distortion the threshold calculating unit 13 calculates from the signal power fed from the power calculating unit 12. The comparator 36 compares them, and supplies the substituting unit 37 with "1" when the distortion fed from the minimum distortion selecting unit 35 is greater than the threshold value fed from the threshold calculating unit 13, and otherwise with"0" as the compared result.

Receiving the decision result output from the deciding unit 14 and the compared result output from the comparator 36, the substituting unit 37 replaces, when both of them are "1", the driving excitation and the driving excitation code fed from the minimum distortion selecting unit 35 with the driving excitation and the driving excitation code fed from the driving excitation coding unit 9. Otherwise, it does not perform the substitution. The substituting unit 37 supplies the final driving excitation and driving excitation code obtained as the result of the replacement to the gain coding unit 6 and multiplexer 7, respectively.

Next, the reason that the present embodiment 4 can improve the subjective quality, that is, the quality of the speech obtained by decoding the resultant speech code 8 by the speech decoding apparatus will be described with reference to FIG. 7.

FIG. 7 is a conceptual drawing showing waveforms to illustrate the selection of the excitation mode to minimize the coding distortion: FIG. 7(*a*) illustrates the input speech; FIG. 7(*b*) illustrates the decoded speech when the excitation mode that is prepared to express noisy speech is selected; and FIG. 7(*c*) illustrates the decoded speech when the excitation mode that is prepared to express vowel-like speech is selected. Because the modeling does not function satisfactorily when the input speech 1 is noisy as illustrated in FIG. 7(*a*), the distortion ratio in the encoding becomes rather large either in the case of FIG. 7(*b*) that utilizes the excitation mode prepared to express noisy speech, or in the case of FIG. 7(*c*) that utilizes the excitation mode prepared to express vowel-like speech.

Here, the driving excitation coding unit 9 employs the time-series vectors generated from random numbers, and corresponds to the excitation mode prepared to express the noisy speech as illustrated in FIG. 7(*b*). In contrast, the driving excitation coding units 10 and 11 employ a pulse excitation and pitch filtering, and correspond to the excitation mode prepared to express the vowel-like speech as illustrated in FIG. 7(*c*).

Although all the distortions D the individual driving excitation coding units 9–11 output are large, the minimum distortion selecting unit 35 usually selects the distortion supplied from the driving excitation coding unit 10 or 11. This is because the distortions D output from these units are usually smaller because of smaller coding distortions at portions with large amplitude. Even then, the selected minimum distortion D is greater than the threshold value $D_{th}$ fed from the threshold calculating unit 13 in this case. Thus, the substituting unit 37 replaces the driving excitation code of the driving excitation coding unit 10 or 11 the minimum distortion selecting unit 35 outputs with the driving excitation code the driving excitation coding unit 9 outputs, thereby producing the decoded speech as shown in FIG. 7(*b*). Thus, even when the distortion of the decoded speech as illustrated in FIG. 7(*b*) is greater than that of the decoded speech as illustrated in FIG. 7(*c*), the decoded speech as illustrated in FIG. 7(*b*) is selected consistently in a segment in which the distortion ratio in the coding is large such as in the noisy segment.

As the embodiment 1, the present embodiment 4 can be configured such that the individual driving excitation coding units 9–11 search for the driving excitation code that will maximize the evaluation value d of the foregoing equation (3), and output the evaluation value d instead of the distortion D. In this case, the minimum distortion selecting unit 35 selects the maximum evaluation value, and the comparator 36 must reverse the compared result to be output. In addition, the threshold calculating unit 13 must calculate the threshold value $d_{th}$ corresponding to evaluation value d.

In addition, the present embodiment 4 can be modified such that the threshold calculating unit 13 outputs the fixed threshold values, and the individual driving excitation coding units 9–11 can output the distortion ratios, that is, the values obtained by dividing their distortions by the signal power of the input speech 1. Furthermore, it can be modified such that the power calculating unit 12 calculates the signal power of the target signal to be encoded supplied from the adaptive excitation coding unit 4, or calculates the amplitude or logarithmic power instead of the signal power.

In addition, although the present embodiment 4 comprises a single driving excitation coding unit for generating the noisy excitation, the driving excitation coding unit 9, and two driving excitation coding units for generating the non-noisy excitation, the driving excitation coding units 10 and 11, this is not essential. For example, it can comprise two or more driving excitation coding units for generating the noisy excitation, or one or more than two driving excitation coding units for generating the non-noisy excitation.

Furthermore, although the present embodiment 4 adopts the simple squared distance between the signals as the distortion, this is not essential. For example, the perceptually weighted distortion that is used often in a speech coding apparatus is also applicable.

As described above, the present embodiment 4 is configured such that it selects one of the plurality of excitation modes, and when encoding the input speech 1 frame by frame which is a segment with a predetermined length by using the excitation mode selected, it encodes, in the individual excitation modes, the target signal to be encoded which is obtained from the input speech, and selects one of the encoded signals, and that it compares the selected one with the threshold value which is determined in accordance with the coding distortion involved in the encoding and with the fixed threshold value or the threshold value determined in response to the signal power of the target signal to be encoded, and carries out the output conversion of the coding distortion in response to the compared result. Thus, it can select the excitation mode with smaller degradation in the decoded speech even when the coding distortion is large. As a result, the present embodiment 4 can select the favorable excitation mode that will provide better speech quality, thereby offering an advantage of being able to improve the speech quality, that is, the subjective quality of the decoded speech obtained by decoding the resultant speech code by the speech decoding apparatus.

As described above, the present embodiment 4 can select the excitation mode with lesser degradation in the decoded speech, even when the distortion ratio involved in the encoding is greater than a predetermined value as in the foregoing embodiment 1. Besides, as for the input speech that will bring about less degradation in the decoded speech even for large coding distortion, since the present embodiment 4 carries out the same excitation mode selection as the conventional example, it can achieve more careful selection of the excitation mode. In addition, since it can change the control of the excitation mode selection based on the coding distortion in the sections of speech that are likely to provide large coding distortion, or in the remaining sections, it can reduce the degradation in the onset of speech, and improve the excitation mode selection in the remaining sections. Furthermore, when the coding distortion is large, the present embodiment can facilitate selecting the excitation mode that will generate the noisy excitation, or the excitation mode that uses the noisy excitation codes, thereby preventing the degradation caused by selecting the excitation mode that generates the non-noisy excitation or the excitation mode that uses the non-noisy excitation codes. Thus, the present embodiment 4 can select the favorable excitation mode that will provide a better speech quality, thereby offering an advantage of being able to improve the subjective quality of the decoded speech obtained by decoding the resultant speech code.

Moreover, the present embodiment 4 is configured such that it selects the minimum coding distortion, compares the selected coding distortion with the threshold value, and selects the driving excitation mode in response to the compared result. As a result, when the coding distortion is large, the present embodiment 4 can forcibly select the excitation mode with less quality degradation in the decoded speech. Thus, the present embodiment 4 can select the favorable excitation mode that will provide better speech quality, thereby offering an advantage of being able to improve the subjective quality of the decoded speech obtained by decoding the resultant speech code.

Finally, the present embodiment 4 is configured such that it selects the minimum coding distortion, and selects the predetermined driving excitation mode when the selected coding distortion exceeds the threshold value. As a result, when the coding distortion is large, the present embodiment 4 can forcibly select the excitation mode with less quality degradation in the decoded speech. Thus, the present embodiment 4 can select the favorable excitation mode that will provide better speech quality, thereby offering an advantage of being able to improve the subjective quality of the decoded speech obtained by decoding the resultant speech code.

Embodiment 5

Figure 5:
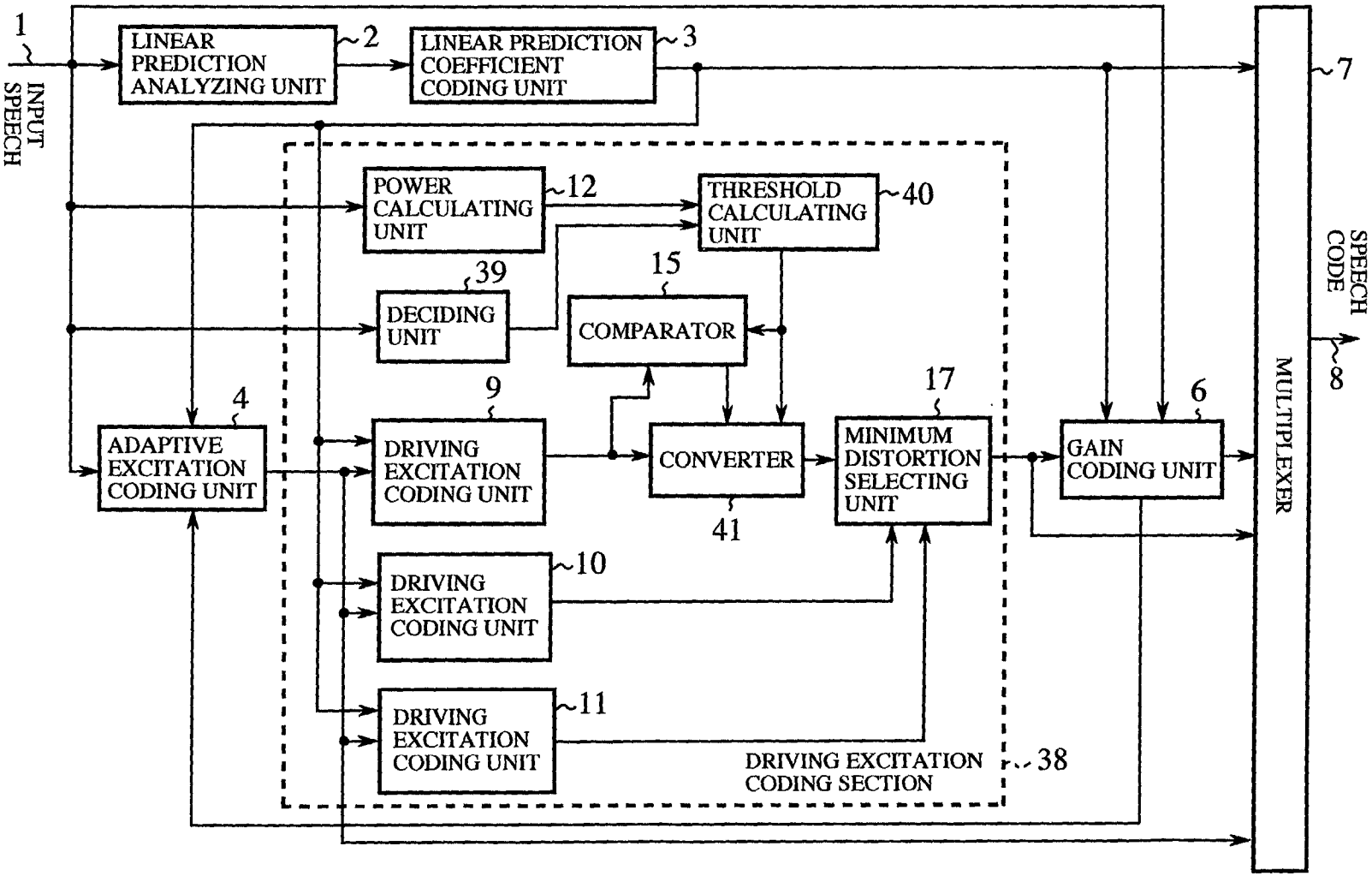
FIG. 5 is a block diagram showing a configuration of a speech coding apparatus employing a speech coding method of an embodiment 5 in accordance with the present invention.

FIG. 5 is a block diagram showing a configuration of a speech coding apparatus employing a speech coding method of an embodiment 5 in accordance with the present invention. In this figure, the same or like portions to those of FIG. 1 are designated by the same reference numerals, and the description thereof is omitted here. In FIG. 5, the reference numeral 38 designates a driving excitation coding section for generating a driving excitation, driving excitation code and mode selection information from the input speech 1, the signal from the linear prediction coefficient coding unit 3 and the signal from the adaptive excitation coding unit 4.

The reference numeral 39 designates a deciding unit for making a decision as to whether the input speech 1 is at the onset or not by analyzing it. The deciding unit 39 differs from the deciding unit 14 in FIG. 1 in that it supplies the decision result to a threshold calculating unit 40 rather than to the converter 16. The reference numeral 40 designates the threshold calculating unit for calculating the threshold value from the decision result fed from the deciding unit 39 and the signal power from the power calculating unit 12. The reference numeral 41 designates a converter for converting the output of the driving excitation coding unit 9 in response to the compared result of the comparator 15. Here, the driving excitation coding section 38 comprises the deciding unit 39, threshold calculating unit 40, converter 41, driving excitation coding units 9–11, power calculating unit 12, comparator 15 and minimum distortion selecting unit 17.

Next, the operation of the present embodiment 5 will be described with reference to FIG. 5 with placing emphasis on the portions different from those of the foregoing embodiment 1.

In this case also, the linear prediction coefficients quantized by the linear prediction coefficient coding unit 3 and the target signal to be encoded fed from the adaptive excitation coding unit 4 are supplied to the driving excitation coding units 9–11 in the driving excitation coding section 34. The driving excitation coding unit 9, using the driving excitation codebook storing a plurality of time-series vectors generated from random numbers, selects the driving excitation code that will minimize the distortion involved in encoding the target signal to be encoded, and supplies the converter 41 and comparator 15 with the time-series vector corresponding to the selected driving excitation code as the driving excitation along with the minimum distortion and the driving excitation code. The driving excitation coding units 10 and 11, using the driving excitation codebooks including different pulse position tables, each select the driving excitation code that will minimize the distortion involved in encoding the target signal to be encoded, and supply the minimum distortion selecting unit 17 with the time-series vector corresponding to the selected driving excitation code as the driving excitation along with the minimum distortion and driving excitation code.

In this case, the driving excitation codebook of the driving excitation coding unit 9 stores the noisy excitation codewords generated from random numbers. In contrast, the driving excitation codebooks of the driving excitation coding units 10 and 11 comprise non-noisy excitation codewords based on the pulse position table or the like. Furthermore, the time-series vectors output from the driving excitation coding unit 9 generate the noisy excitation, and the time-series vectors output from the driving excitation coding units 10 and 11 generate the non-noisy excitation.

The power calculating unit 12 calculates the signal power in each frame of the input speech 1, and supplies it to the threshold calculating unit 40. The deciding unit 39 decides the aspect of speech of the input speech 1 by analyzing it, and supplies the threshold calculating unit 40 with "0" when it is the onset of speech, and with "1" otherwise.

When the decision result of the deciding unit 39 is "0", the threshold calculating unit 40 multiplies the signal power from the power calculating unit 12 by a first constant associated with the distortion ratio, which is prepared in advance. On the other hand, when the decision result of the deciding unit 39 is "1", the threshold calculating unit 40 multiplies the signal power from the power calculating unit 12 by a second constant associated with the distortion ratio, which is prepared in advance. The threshold calculating unit 40 supplies the resultant product to the comparator 15 and converter 41 as the threshold value associated with the distortion. Here, the first constant is set greater than the second constant. For example, the first constant is set at 0.9, and the second constant at 0.7.

Comparing the distortion fed from the driving excitation coding unit 9 with the threshold value fed from the threshold calculating unit 40, the comparator 15 supplies the converter 41 with "1" when the distortion is greater than the threshold value, and otherwise with "0" as the compared result. When the compared result output from the comparator 15 is "1", the converter 41 replaces the distortion of the resultant output from the driving excitation coding unit 9 by the threshold value fed from the threshold calculating unit 40, and supplies it to the minimum distortion selecting unit 17. In the other cases, the distortion in the resultant output from the driving excitation coding unit 9 is supplied immediately to the minimum distortion selecting unit 17 without change.

The minimum distortion selecting unit 17 compares the distortion supplied from the converter 41, and the distortions supplied from the driving excitation coding units 10 and 11, and selects the minimum distortion among them. The converter 41 or the driving excitation coding unit 10 or 11 that outputs the selected minimum distortion supplies the driving excitation to the gain coding unit 6, and the driving excitation code to the multiplexer 7. In addition, it supplies the multiplexer 7 with the mode selection information indicating which one of the three distortions is selected.

Next, the reason that the present embodiment 5 can improve the subjective quality, that is, the quality of the decoded speech obtained by decoding the resultant speech code 8 by the speech decoding apparatus will be described with reference to FIG. 7.

FIG. 7 is a conceptual drawing showing waveforms to illustrate the selection of the excitation mode to minimize the coding distortion. Because the modeling does not function satisfactorily when the input speech 1 is noisy as illustrated in FIG. 7(*a*), the distortion ratio in the encoding becomes rather large either in the case of FIG. 7(*b*) that utilizes the excitation mode prepared to express noisy speech, or in the case of FIG. 7(*c*) that utilizes the excitation mode prepared to express vowel-like speech.

Here, the driving excitation coding unit 9, which corresponds to the excitation mode prepared to express the noisy speech as illustrated in FIG. 7(*b*), employs the time-series vectors generated from random numbers. In contrast,the driving excitation coding units 10 and 11, which correspond to the excitation mode prepared to express the vowel-like speech as illustrated in FIG. 7(*c*), employ a pulse excitation and pitch filtering.

When the deciding unit 39 makes a decision that the aspect of speech is the onset of speech, and outputs the decision result "0", the threshold calculating unit 40 outputs a rather large threshold value. Thus, although the distortion D output from the driving excitation coding unit 9 is large, it does not exceed the threshold value, thereby preventing the substitution by the converter 41. As a result, the minimum distortion selecting unit 17 selects the driving excitation coding unit 10 or 11, the distortion D of which is smaller in such cases because of smaller coding distortions at portions with large amplitude, thereby providing the decoded speech as shown in FIG. 7(*c*).

In contrast, when the deciding unit 39 makes a decision that the aspect of speech is other than the onset of speech, and outputs the decision result "1", the threshold calculating unit 40 outputs a rather small threshold value. Accordingly, the distortion D the driving excitation coding unit 9 outputs exceeds the threshold value so that the converter 41 replaces the distortion D with a smaller threshold value $D_{th}$. As a result, the minimum distortion selecting unit 17 selects the driving excitation code the driving excitation coding unit 9 outputs, thereby providing the decoded speech as shown in FIG. 7(*b*). Thus, even when the distortion of the decoded speech as illustrated in FIG. 7(*b*) is greater than that of the decoded speech as illustrated in FIG. 7(*c*), the decoded speech as illustrated in FIG. 7(*b*) is selected consistently in a segment in which the distortion ratio in the coding is large such as in the noisy segment.

If the converter 41 carries out the replacement even in the onset of speech to make the decoded speech as shown in FIG. 7(*b*) by using a rather small threshold value, the pulse-like characteristics of plosives can be corrupted, or the onsets of vowels are degraded to harsh speech quality. The present embodiment 5 prevents the degradation at the onset by deciding the threshold value in response to the decision result by the deciding unit 39.

As the embodiment 1, the present embodiment 5 can be configured such that the individual driving excitation coding units 9–11 search for the driving excitation code that will maximize the evaluation value d of the foregoing equation (3), and output the evaluation value d instead of the distortion D. In this case, the minimum distortion selecting unit 17 selects the maximum evaluation value, and the comparator 15 must reverse the compared result to be output. In addition, the threshold calculating unit 40 must calculate the threshold value $d_{th}$ corresponding to evaluation value d.

In addition, the present embodiment 5 can be modified such that the threshold calculating unit 40 outputs the first or second constant as the threshold value without change, and the individual driving excitation coding units 9–11 can output the distortion ratios, that is, the values obtained by dividing their distortions by the signal power of the input speech 1. Furthermore, it can be modified such that the power calculating unit 12 calculates the signal power of the target signal to be encoded supplied from the adaptive excitation coding unit 4, or calculates the amplitude or logarithmic power instead of the signal power.

In addition, although the present embodiment 5 comprises a single driving excitation coding unit for generating the noisy excitation, the driving excitation coding unit 9, and two driving excitation coding units for generating the non-noisy excitation, the driving excitation coding units 10 and 11, this is not essential. For example, it can comprise two or more driving excitation coding units for generating the noisy excitation, or one or more than two driving excitation coding units for generating the non-noisy excitation.

Furthermore, although the present embodiment 5 adopts the simple squared distance between the signals as the distortion, this is not essential. For example, the perceptually weighted distortion that is used often in a speech coding apparatus is also applicable.

Although the present embodiment 5 is configured such that the threshold calculating unit 40 selects one of the two predetermined constants associated with the distortion ratio in response to the decision result of the deciding unit 39, this is not essential. For example, increasing the number of the decision results to three or more makes it possible to increase the number of the constants corresponding to the decision results, thereby enabling more fine control. In addition, the present embodiment 5 can be modified such that the deciding unit 39 calculates decision parameters with consecutive values by analyzing the input speech 1, and that the threshold calculating unit 40 calculates the threshold values based on the consecutive values in response to the decision parameters.

As described above, the present embodiment 5 can select the excitation mode with lesser degradation in the decoded speech, even when the coding distortion is large or the distortion ratio involved in the encoding is greater than a predetermined value as in the foregoing embodiment 1. Besides, the driving excitation mode whose coding distortion is replaced is more easily selected even when the coding distortion is large. In addition, since it can change the control of the excitation mode selection based on the coding distortion for the sections of speech that are likely to provide large coding distortion, or for the remaining sections, it can reduce the degradation in the onset of speech, and improve the excitation mode selection in the remaining sections. Furthermore, when the coding distortion is large, the present embodiment can facilitate selecting the excitation mode that will generate the noisy excitation, or the excitation mode that uses the noisy excitation codes, thereby preventing the degradation caused by selecting the excitation mode that generates the non-noisy excitation or the excitation mode that uses the non-noisy excitation codes. Thus, the present embodiment 5 can select a favorable excitation mode that will provide a better speech quality, thereby offering an advantage of being able to improve the subjective quality of the decoded speech obtained by decoding the resultant speech code.

Finally, the present embodiment 5 is configured such that it decides the aspect of speech by analyzing the input speech 1 or target signal to be encoded, and carries out the comparison using the threshold value determined in accordance with the decision result. Thus, it can select the excitation mode using the threshold value that is appropriately set in response to the aspect of speech. As a result, the present embodiment 5 offers an advantage of being able to improve the subjective quality of the decoded speech obtained by decoding the resultant speech code.

Embodiment 6

Figure 6:
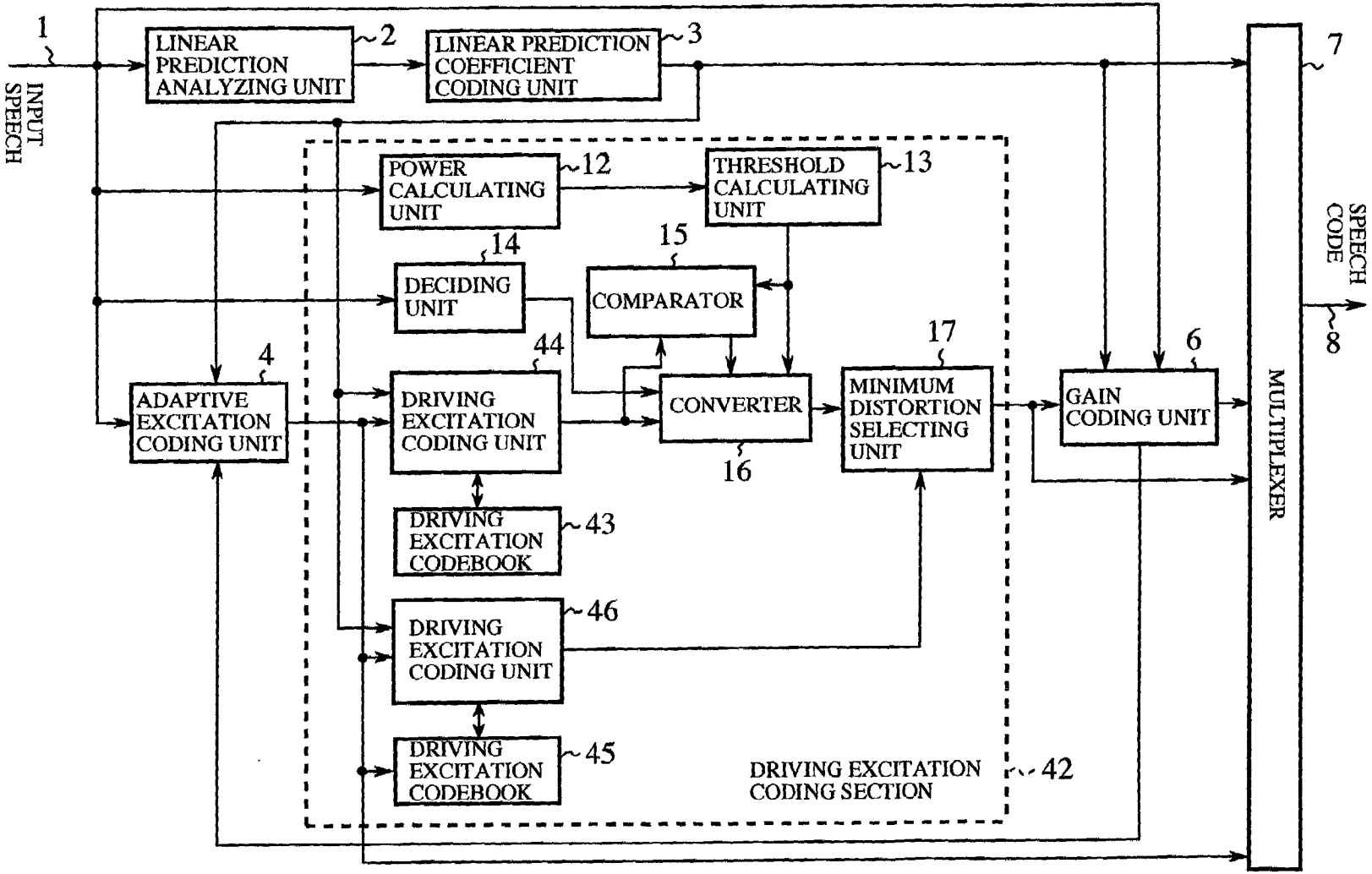
FIG. 6 is a block diagram showing a configuration of a speech coding apparatus employing a speech coding method of an embodiment 6 in accordance with the present invention.

FIG. 6 is a block diagram showing a configuration of a speech coding apparatus utilizing a speech coding method of an embodiment 6 in accordance with the present invention. In this figure, the same or like portions to those of FIG. 1 are designated by the same reference numerals, and the description thereof is omitted here. In FIG. 6, the reference numeral 42 designates a driving excitation coding section for generating the driving excitation, driving excitation code and mode selection information from the input speech 1, the signal fed from the linear prediction coefficient coding unit 3 and the signal fed from the adaptive excitation coding unit 4.

The reference numeral 43 designates a driving excitation codebook consisting of time-series vectors generated from random numbers; 44 designates a driving excitation coding unit that generates, by using the driving excitation codebook 43, the driving excitation by detecting a distortion between the temporary synthesized signal and the target signal to be encoded by using the signals fed from the linear prediction coefficient coding unit 3 and the adaptive excitation coding unit 4. The reference numeral 45 designates a driving excitation codebook including a pulse position codebook; and 46 designates a driving excitation coding unit that generates, by using the driving excitation codebook 45, the driving excitation by detecting a distortion between the temporary synthesized signal and the target signal to be encoded by using the signals fed from the linear prediction coefficient coding unit 3 and the adaptive excitation coding unit 4. The driving excitation coding section 42 comprises the power calculating unit 12, threshold calculating unit 13, deciding unit 14, comparator 15, converter 16, minimum distortion selecting unit 17, driving excitation codebooks 43 and 45, and driving excitation coding units 44 and 46.

Next, the operation of the present embodiment 6 will be described with reference to FIG. 6 with placing emphasis on the portions different from those of the foregoing embodiment 1.

The driving excitation codebook 43 stores a plurality of time-series vectors generated from random numbers. The driving excitation codebook 43, receiving the excitation code represented by a binary number of a few bits, reads the time-series vector stored at the position corresponding to the excitation code, and outputs it. The driving excitation coding unit 44 obtains a temporary synthesized signal by filtering the time-series vector, which is obtained by inputting each driving excitation code to the driving excitation codebook 43, through a synthesis filter that uses the quantized linear prediction coefficients supplied from the linear prediction coefficient coding unit 3. Then, it detects the distortion between a signal which is obtained by multiplying the resultant temporary synthesized signal by an appropriate gain and a target signal to be encoded which is supplied from the adaptive excitation coding unit 4.

The driving excitation coding unit 44 performs this processing on all the excitation codes. Thus, it selects the excitation code that gives the minimum distortion, and supplies the time-series vector corresponding to the selected excitation code to the comparator 15 and converter 16 as the driving excitation along with the minimum distortion and excitation code.

The driving excitation codebook 45 stores a codebook including a pulse position table. The driving excitation codebook 45, receiving the driving excitation code represented by a binary number of a few bits, divides the driving excitation code into plural pulse position codes and plural polarities, reads the pulse positions stored in the positions corresponding to the individual pulse position codes in the pulse position table, and outputs a time-series vector having a plurality of pulses in response to the pulse positions and polarities. The driving excitation codebook 45 further conducts the pitch filtering of the time-series vector which is generated, with the repetition period corresponding to the adaptive excitation code selected by the adaptive excitation coding unit 4, and supplies it to the driving excitation coding unit 46.

The driving excitation coding unit 46 obtains the temporary synthesized signal by filtering the time-series vector, which is obtained by inputting the driving excitation code to the driving excitation codebook 45, through the synthesis filter that uses the quantized linear prediction coefficients output from the linear prediction coefficient coding unit 3. Then, it detects the distortion between the signal which is obtained by multiplying the resultant temporary synthesized signal by an appropriate gain and the target signal to be encoded which is supplied from the adaptive excitation coding unit 4. The driving excitation coding unit 46 performs this processing on all the excitation codes, selects the excitation code that gives the minimum distortion, adopts the time-series vector corresponding to the selected excitation code as the driving excitation, and supplies it to the minimum distortion selecting unit 17 along with the minimum distortion and excitation code.

In this case also, the driving excitation codebook 43 of the driving excitation coding unit 14 stores the noisy excitation codewords generated from random numbers. In contrast, the driving excitation codebook 45 of the driving excitation coding unit 46 stores non-noisy excitation codewords based on the pulse position table or the like. Here, the time-series vectors output from the driving excitation coding unit 44 generate the noisy excitation, and the time-series vectors output from the driving excitation coding unit 46 generates the non-noisy excitation.

The power calculating unit 12 calculates the signal power in each frame of the input speech 1 provided thereto, and supplies the resultant signal power to the threshold calculating unit 13. The threshold calculating unit 13 multiplies the signal power fed from the power calculating unit 12 by a constant associated with the distortion ratio prepared in advance, and supplies the calculation result to the comparator 15 and converter 16 as the threshold value associated with the distortion. The deciding unit 14 analyzes the input speech 1 supplied, and decides its aspect of speech. Thus, it assigns "0" to the onset of speech, and "1" to the remaining portions, and supplies them to the threshold calculating unit 13.

The comparator 15 compares the distortion supplied from the driving excitation coding unit 44 with the threshold value fed from the threshold calculating unit 13, and supplies the converter 16 with "1" when the distortion is greater than the threshold value, and otherwise with "0". Receiving the decision result from the deciding unit 14 and the compared result from the comparator 15, the converter 16 replaces, when both of them are "1", the distortion fed from the driving excitation coding unit 44 by the threshold value fed from the threshold calculating unit 13, and supplies it to the minimum distortion selecting unit 17. In the other cases, the converter 16 does not carry out the replacement, and supplies the distortion fed from the driving excitation coding unit 44 to the minimum distortion selecting unit 17 without change.

The minimum distortion selecting unit 17 compares the distortion supplied from the converter 16 with the distortion fed from the driving excitation coding unit 46, and selects the smaller distortion between them. It supplies the driving excitation and driving excitation code, which are output from the converter 16 or the driving excitation coding unit 46 that outputs the minimum distortion, to the gain coding unit 6 and multiplexer 7, respectively. In addition, it supplies the multiplexer 7 with information indicating which one of the two distortions is selected, as the mode selection information.

The code processing of the driving excitation coding unit 44 and that of the driving excitation coding unit 46 differ only in that they access different driving excitation codebooks 43 and 45. In such a case, the driving excitation codebooks 43 and 45 can be integrated into one body, so that a single driving excitation coding unit can achieve the search. In this case, the same result can be accomplished by calculating the distortion due to the driving excitation corresponding to the driving excitation codebook 43, and that corresponding to the driving excitation codebook 45, independently, and by supplying the former distortion to the converter 16. In other words, the present embodiment 6 is applicable to the such a case that classifies the driving excitation codes of the single driving excitation codebook into those corresponding to the noisy codewords and those corresponding to the non-noisy codewords, and that employs the former as the driving excitation codebook 43, and the latter as the driving excitation codebook 45.

As the foregoing embodiment 1, the present embodiment 6 can be modified such that the driving excitation coding units 44 and 46 search for the driving excitation code that will maximize the evaluation value d of the foregoing equation (3), and output the evaluation value d instead of the distortion D. In this case, the minimum distortion selecting unit 17 selects the maximum evaluation value, and the comparator 15 must reverse the compared result to be output. In addition, the threshold calculating unit 13 must calculate the threshold value $d_{th}$ corresponding to evaluation value d.

In addition, the present embodiment 6 can be modified such that the threshold calculating unit 13 outputs the constant associated with the distortion ratio without change as the threshold value, and the individual driving excitation coding units 44 and 46 output the distortion ratios, that is, the values obtained by dividing their distortions by the signal power of the input speech 1. Furthermore, it can be modified such that the power calculating unit 12 calculates the signal power of the target signal to be encoded supplied from the adaptive excitation coding unit 4, or calculates the amplitude or logarithmic power instead of the signal power.

In addition, although the present embodiment 6 comprises a single driving excitation coding unit for generating the noisy excitation, the driving excitation coding unit 44, and a single driving excitation coding unit for generating the non-noisy excitation, the driving excitation coding unit 46, it can comprise two or more of them.

Furthermore, although the present embodiment 6 adopts the simple squared distance between the signals as the distortion, this is not essential. For example, the perceptually weighted distortion that is used often in a speech coding apparatus is also applicable.

As described above, as the foregoing embodiment 1, the present embodiment 6 can select the excitation mode with lesser degradation in the decoded speech, even when the coding distortion is large or the distortion ratio involved in the encoding is greater than a predetermined value. Besides, it becomes easier to select the driving excitation mode whose coding distortion is replaced, even when the coding distortion is large. In addition, as for the input speech that will bring about little degradation in the decoded speech even for large coding distortion, since the present embodiment 6 carries out the same excitation mode selection as the conventional example, it can achieve more careful selection of the excitation mode. In addition, since it can change the control of the excitation mode selection based on the coding distortion for the sections of speech that are likely to provide large coding distortion, or for the remaining sections, it can reduce the degradation in the onset of speech, and improve the excitation mode selection in the remaining sections. Furthermore, when the coding distortion is large, the present embodiment can facilitate selecting the excitation mode that will generate the noisy excitation, or the excitation mode that uses the noisy excitation codes, thereby preventing the degradation caused by selecting the excitation mode that generates the non-noisy excitation or the excitation mode that uses the non-noisy excitation codes. Thus, the present embodiment 6 can select the favorable excitation mode that will provide a better speech quality, thereby offering an advantage of being able to improve the subjective quality of the decoded speech obtained by decoding the resultant speech code.

Embodiment 7

Although the foregoing embodiment 2 comprises the plurality of driving excitation coding units 19–21, each of which includes the adaptive excitation coding unit and driving excitation coding unit, and selects one of the plurality of driving excitation coding units, it can be modified such that it comprises a plurality of higher level driving excitation coding units, each of which includes the gain coding unit 6 in addition to the foregoing components, and selects one of the plurality of driving excitation coding units with such a configuration.

As for the foregoing embodiments 3–6 also, they can be modified such that they comprise a plurality of driving excitation coding units, each of which includes the adaptive excitation coding unit 4 and the driving excitation coding units 9–11 or 44 and 46, and selects one of the plurality of driving excitation coding units, or that they comprise the higher level driving excitation coding units each including the gain coding unit 6 in addition, and selects one of the plurality of driving excitation coding units.

Thus, the speech coding method, which comprises a plurality of higher level excitation modes and encodes the input speech frame by frame with a predetermined length using the excitation modes, can select the excitation mode with less degradation in the decoded speech when the coding distortion is large, by encoding in the individual driving excitation mode the target signal to be encoded that is obtained from the input speech, by comparing the current coding distortion with the fixed threshold value or with the threshold value determined in response to the signal power of the target signal to be encoded, and by selecting the excitation mode in response to the compared result. Thus, the speech coding method can select a favorable driving excitation mode that will provide better speech quality, thereby offering an advantage of being able to improve the subjective quality of the decoded speech obtained by decoding the resultant speech code by the speech decoding apparatus.

What is claimed is:

1. A speech coding method of selecting an excitation mode from a plurality of excitation modes, and encoding an input speech frame by frame with a predetermined length by using the excitation mode selected, said speech coding method comprising the steps of:

encoding in the respective excitation modes a target signal to be encoded that is obtained from the input speech, and outputting coding distortions involved in the encoding;

comparing at least one of the coding distortions output by the step of encoding with a threshold value;

if a coding distortion exceeds the threshold value at the step of comparing, converting one or more coding distortions output by the step of encoding so as to suppress selection of the excitation mode whose coding distortion exceeds the threshold value at the step of comparing; and selecting one of the plurality of excitation modes in response to the coding distortions converted by the step of converting.

2. The speech coding method according to claim 1, wherein the threshold value is one of a fixed threshold value and a threshold value that is determined in response to signal power of the target signal to be encoded.

3. The speech coding method according to claim 1, wherein the threshold value is prepared for each excitation mode.

4. The speech coding method according to claim 1, wherein the step of converting replaces the coding distortion with the threshold value, when a compared result obtained at the step of comparing indicates that the coding distortion by a predetermined excitation mode is greater than the threshold value, and the step of selecting selects an excitation mode corresponding to a minimum coding distortion among the coding distortions of all the excitation modes including the coding distortion replaced at the step of replacing.

5. The speech coding method according to claim 1, wherein the threshold value is set at a value constituting a predetermined distortion ratio to one of the input speech and the target signal to be encoded.

6. The speech coding method according to claim 1, further comprising a step of deciding characteristic of speech by analyzing at least one of the input speech and the target signal to be encoded, wherein the step of converting converts the coding distortions output by the step of encoding only when the step of deciding outputs a predetermined decision result.

7. The speech coding method according to claim 6, wherein the step of deciding makes a decision as to whether characteristic of speech is onset of speech or not.

8. The speech coding method according to claim 1, further comprising the steps of:

deciding characteristic of speech by analyzing at least one of the input speech and the target signal to be encoded; and calculating a threshold value in response to a decision result at the step of deciding, wherein the step of comparing carries out its comparison using the threshold value calculated at the step of calculating the threshold value.

9. The speech coding method according to claim 1, wherein the plurality of excitation modes comprise an excitation mode that generates non-noisy excitation, and an excitation mode that generates noisy excitation.

10. The speech coding method according to claim 1, wherein the plurality of excitation modes comprise an excitation mode that uses non-noisy excitation codewords, and an excitation mode that uses noisy excitation codewords.

11. A speech coding method of selecting an excitation mode from a plurality of excitation modes, and encoding an input speech frame by frame with a predetermined length by using the excitation mode selected, said speech coding method comprising the steps of:

encoding in the respective excitation modes a target signal to be encoded that is obtained from the input speech, and outputting coding distortions involved in the encoding;

selecting one of the excitation modes in response to a compared result obtained by comparing the coding distortions involved in the encoding;

comparing the coding distortion corresponding to the selected excitation mode with a threshold value; and replacing the selected excitation mode with another excitation mode, in response to a particular result of comparing the coding distortion corresponding to the selected excitation mode with the threshold value.

12. The speech coding method according to claim 11, wherein the step of replacing selects a predetermined excitation mode when the coding distortion corresponding to the excitation mode selected at the step of selecting is greater than the threshold value.

13. A speech coding apparatus that selects an excitation mode from a plurality of excitation modes, and encodes an input speech frame by frame with a predetermined length by using the excitation mode selected, said speech coding apparatus comprising:

coding units for encoding in the respective excitation modes a target signal to be encoded that is obtained from the input speech, and outputting coding distortions involved in the encoding;

a comparator for comparing at least one of the coding distortions output by the coding unit with a threshold value;

a converter for converting one or more coding distortions output by the coding unit when a distortion value exceeds the threshold value at the comparator, the conversion being performed so as to suppress selection of an excitation mode whose coding distortion exceeds the threshold value at the comparator; and a selecting unit for selecting the excitation mode in response to the coding distortions converted by the coding units.

14. The speech coding apparatus according to claim 13, wherein said comparator sets threshold value to be compared with the coding distortion output from the coding unit, at a value constituting a predetermined distortion ration to the target signal to be encoded.

15. The speech coding apparatus according to claim 13, further comprising a deciding unit for deciding characteristic of speech by analyzing at least one of the input speech and the target signal to be encoded, wherein the converter converts the coding distortion output from the coding unit, only when said deciding unit outputs a predetermined decision result.

16. The speech coding apparatus according to claim 13, wherein the plurality of excitation modes comprise an excitation mode that generates non-noisy excitation, and an excitation mode that generates noisy excitation.

17. A speech coding apparatus for selecting an excitation mode from a plurality of excitation modes, and encoding an input speech frame by frame with a predetermined length by using the excitation mode selected, said speech coding apparatus comprising:

coding units for encoding in the respective excitation modes a target signal to be encoded that is obtained from the input speech, and outputting coding distortions involved in the encoding;

a selecting unit for comparing the coding distortions output from the coding units, and for selecting one of the excitation modes in response to a compared result obtained;

a comparator for comparing the coding distortion corresponding to the excitation mode selected by said selecting unit with a threshold value; and a substituting unit for replacing the excitation mode selected by said selecting unit to other excitation mode in response to a particular comparison result obtained by said comparator.

* * * * *